US006283571B1

(12) United States Patent
Zhou et al.

(10) Patent No.: US 6,283,571 B1
(45) Date of Patent: Sep. 4, 2001

(54) PRINTER AND RECORDING MEDIUM

(75) Inventors: Shixin Zhou; Koichi Otsuki, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/340,040

(22) Filed: Jun. 28, 1999

(30) Foreign Application Priority Data

Jul. 3, 1998 (JP) ..... 10-204393

(51) Int. Cl.[7] ..... B41J 2/21
(52) U.S. Cl. ..... 347/15; 347/40; 347/43
(58) Field of Search ..... 347/10, 12, 15, 347/40, 41, 43

(56) References Cited

U.S. PATENT DOCUMENTS

| | | | | |
|---|---|---|---|---|
| 5,384,587 | * | 1/1995 | Takagi et al. | 347/41 |
| 5,600,352 | * | 2/1997 | Knierrim et al. | 347/40 |
| 5,696,542 | * | 12/1997 | Matsubara et al. | 347/12 |
| 5,729,259 | * | 3/1998 | Gotoh et al. | 347/43 |
| 5,923,349 | * | 7/1999 | Meyer | 347/43 |
| 6,024,438 | * | 1/1995 | Koike et al. | 347/43 |

FOREIGN PATENT DOCUMENTS

| | | |
|---|---|---|
| 0 517 543 | 12/1992 | (EP) . |
| 0 719 647 | 7/1996 | (EP) . |
| 0 750 995 | 1/1997 | (EP) . |
| 0 817 112 | 1/1998 | (EP) . |

* cited by examiner

*Primary Examiner*—N. Le
*Assistant Examiner*—Lamson D. Nguyen
(74) *Attorney, Agent, or Firm*—Oblon, Spivak, McClelland, Maier & Neustadt, P.C.

(57) ABSTRACT

In a conventional printer that enables creation of different types of dots having different sizes, banding often appears in a certain area where only small-diametral dots are created. In a multi-value printer that enables creation of both a large dot and a small dot, the technique of the present invention stores in advance the relations between the recording ratios of the large dot and the small dot and the tone value into a ROM and carries out a multi-valuing process based on the relations. In a certain area where only small dots are created, a conspicuous banding often appears when the recording ratio of the small dot exceeds a certain upper limit value. Large dots are accordingly mixed with small dots in a specific area where the recording ratio of the small dot exceeds the upper limit value. The upper limit value depends upon a printing condition including the type of a printing medium, so that the recording ratios of the respective dots are set corresponding to each printing condition. This arrangement enables small dots to be used effectively in the range that does not cause any conspicuous banding and thereby ensures the high picture quality of a resulting printed image.

18 Claims, 15 Drawing Sheets

TM

| | | | |
|---|---|---|---|
| 1 | 9 | 3 | 11 |
| 13 | 5 | 15 | 7 |
| 4 | 12 | 2 | 10 |
| 16 | 8 | 14 | 6 |

UM

| | | | |
|---|---|---|---|
| 16 | 8 | 14 | 6 |
| 4 | 12 | 2 | 10 |
| 13 | 5 | 15 | 7 |
| 1 | 9 | 3 | 11 |

PRINTER AND RECORDING MEDIUM

BACKGROUND OF THE INVENTION

1. Field of the Invention

The present invention relates to a printer that prints an image with a head having nozzles that enable creation of dots having different quantities of ink.

2. Description of the Related Art

Ink jet printers that create dots with a plurality of color inks ejected from a plurality of nozzles formed on a head to record an image have been proposed as an output apparatus of a computer. The ink jet printers are widely used to print images processed by the computer in a multi-color, multi-tone manner. In such printers, each pixel is generally expressed by two tones, that is, the dot-on state and the dot-off state. The image is accordingly printed after the halftone processing, which is the image processing to enable the tones of original image data to be expressed by dispersibility of dots.

Multi-value printers, which are ink jet printers that enable expression of two or more tones, have recently been proposed to enrich the tone expression. Such printers include a printer that enables expression of three or more different densities by changing the quantity of ink or the density of ink and a printer that enables multi-tone expression by creating a plurality of dots in an overlapping manner in each pixel. The halftone processing is still required in such printers, since the tone of the original image data is not sufficiently expressible in each pixel.

In the multi-value printer, it is required to determine the recording ratio of each type of dot according to the tone value of the original image data in the course of the halftone processing. The conventional technique sets the recording ratio of each type of dot to appropriately express a variation in tone value and ensure the favorable granularity of the resulting printed image. Especially from the viewpoint of the improved granularity, there is a tendency of creating a large number of dots having a less quantity of ink.

In the multi-value printer that changes the quantity of ink, however, when a large number of a specific type of dot, which has a substantially identical size with a recording pitch of dots, banding often appears because of the reason discussed below.

FIG. 23 shows a state of recording only the specific type of dots in a predetermined image area. The rectangle shown on the left side of FIG. 23 represents a head with five nozzles. The open circles shown on the right side represent the specific type of dots. The hatched square denotes one pixel. In order to enable the whole image area to be filled with dots, the size of the specific type of dot is set to be substantially identical with or more precisely only a little greater than each side of the pixel, that is, the recording pitch of dots. In the example of FIG. 23, dots are created at the most ideal positions in the respective pixels. In this case, the predetermined image area can be filled uniformly with the dots.

In the ink jet printer, the respective nozzles generally have different ink ejecting characteristics, which cause a deviation of the dot recording positions. FIG. 24 shows a state of recording the specific type of dots with a deviation of the dot recording positions. In the illustrated example, ink is ejected in oblique directions from the first nozzle and the second nozzle, so that the positions of the dots created by the first nozzle and the second nozzle are deviated from the expected positions. The deviation of the dot recording positions causes unevenness of density or banding in the resulting printed image as clearly shown in FIG. 24. In an extreme case, there is a dropout between adjoining rows of dots.

FIG. 25 shows a state of recording another type of dots, which has a greater area than that of the specific type of dot, with a deviation of the dot recording positions. The symbols in FIG. 25 have the same meanings as those explained in FIGS. 23 and 24. Since there are significant overlaps of dots in the example of FIG. 25, the dots are expressed by the solid line and the dotted line alternately, for the clarity of illustration. There is no practical difference between the dots by the solid line and the dots by the dotted line. As clearly understood from the comparison with the example of FIG. 23, the dots shown in FIG. 25 have the greater size than each side of the pixel or the recording pitch of dots. This increases the overlapped area of the adjoining dots and thereby makes the unevenness of density, which is due to the deviation of the dot recording positions, relatively inconspicuous in the example of FIG. 25, compared with the example of FIG. 24. In the case of the specific type of dot having the substantially identical size with the recording pitch, even a little deviation of the dot recording positions makes the banding significantly conspicuous. The multi-value printer has been developed to enrich the tone expression and enable the high quality printing. The occurrence of the banding, which results in lowering the picture quality, is thus not negligible.

SUMMARY OF THE INVENTION

The object of the present invention is thus to provide a technique that ensures high-quality printing while reducing the occurrence of banding due to recording of a specific type of dot in a multi-value printer.

At least part of the above and the other related objects is attained by a printer with a head having a plurality of nozzles that enable creation of at least two different types of dots having different sizes. The printer determines which of the at least two different types of dots is to be created in each pixel according to a printing condition and a tone value of image data and creates dots based on a result of the determination with the head, thereby printing an image on a printing medium. The printer includes: a memory unit that stores relations between the recording ratio of each type of dot and the tone value with regard to printing conditions; a printing condition input unit that inputs a specified printing condition; and a decision unit that determines whether or not each type of dots is to be created in each pixel, based on the recording ratio corresponding to the specified printing condition stored in the memory unit. Different values are set to a limit recording ratio of a specific type of dot, which is selected among the at least two different types of dots and enables independent expression of a certain tone value, corresponding to the printing conditions. The limit recording ratio is specified against a limit tone value, at which a recording ratio of another type of dot having a greater size than the specific type of dot practically starts recording to have a significant value as a recording ratio thereof.

It is preferable that the specific type of dot has a size that is substantially identical with a dot pitch in printing.

It is also preferable that the limit recording ratio is set based on a possibility of occurrence of banding.

The following describes the relation between the recording ratio of the specific type of dot and the banding, prior to description of the functions and effects of the printer of the present invention. As described above with FIG. 24, the banding often appears in the case of recording the specific type of dots. The possibility of the occurrence of banding depends upon the recording ratio of the specific type of dot as discussed below.

FIG. 15 shows a state of recording the specific type of dots. The open circles in FIG. 15 represent the specific type of dots. The example of FIG. 15 regards a relatively low recording ratio and there are a large number of pixels in which no dot is created. Like the example of FIG. 24, there is a deviation of the dot recording positions in the example of FIG. 15. The presence of a gap B2, which is ascribed to pixels where no dot is created, makes a gap B1, which is due to the deviation of the dot recording positions, relatively inconspicuous. This means that the banding is relatively inconspicuous when the specific type of dot has a low recording ratio. FIG. 16 shows a state of recording the specific type of dots at a little greater recording ratio than that of FIG. 15. The hatched circles represent newly created dots in addition to those of FIG. 15. In this case, the banding B1, which is due to the deviation of the dot recording positions, is rather conspicuous.

The inventors have noted the relation between the possibility of the occurrence of banding and the recording ratio of the specific type of dot and completed the present invention. The specific type of dot has a relatively small size and is not readily recognized with naked eyes. From the viewpoint of the granularity of a printed image, it is thus preferable to increase the recording ratio of the specific type of dot. As discussed previously, however, there is an upper limit in increased recording ratio of the specific type of dot to enable recording of the specific type of dot without causing any conspicuous banding. In order to record the specific type of dots at a recording ratio exceeding the upper limit, it is required to mix another type of dots having a greater size than that of the specific type of dot at a significant recording ratio. The upper limit depends upon the printing condition. The arrangement of changing the recording ratio of the specific type of dot according to the printing condition reduces the occurrence of banding corresponding to the printing condition.

The specific type of dot here represents the dot having a size that is substantially identical with each side of the pixel. In the actual state, a variety of other dots may also be regarded as the specific type of dot. For example, the specific type of dot may be any dot that is created alone to express a certain tone value.

As mentioned above, it is preferable that the limit recording ratio is set based on the possibility of the occurrence of banding. Namely the limit recording ratio is set not to cause any conspicuous banding. The limit recording ratio depends upon the printing condition and is thereby set corresponding to each printing condition.

In the printer of the present invention, this arrangement prevents the occurrence of conspicuous banding due to recording of the specific type of dot with regard to any printing condition. The technique of setting the recording ratio of the specific type of dot according to the printing condition enables recording of the specific type of dot at a maximum recording ratio that is allowable in the range where banding does not occur with regard to the printing condition. Such setting thus prevents the occurrence of banding and ensures the high picture quality of the resulting printed image, while keeping the favorable granularity of the printed image, with respect to each printing condition.

In the printer of the present invention, the recording ratio of the specific type of dot is set corresponding to each printing condition. This does not mean that different recording ratios are set corresponding to all the available printing conditions. The recording ratio of the specific type of dot is set equal to a preferable value corresponding to each printing condition by taking into account the possible occurrence of banding. The same recording ratio may thus be set corresponding to some printing conditions.

The 'significant recording ratio' in the specification hereof means that the recording ratio of another type of dot having the greater size than that of the specific type of dot affects the banding due to recording of the specific type of dot.

The dot created by ejecting ink does not always have the shape of a true circle. In the event that dots are created in a shape other than the true circle, such as an ellipse, the dot size implies a mean size. In the stricter definition, the dot size means a size of an equivalent dot of a true circular shape that has an identical area with the area of the dot created by ejecting a certain quantity of ink.

In accordance with one preferable application of the printer, the specified printing condition is the size of a dot created with a certain quantity of ink on said printing medium, and the recording ratio of the specific type of dot increases with an increase in size of the dot.

The size of the specific type of dot created by a fixed quantity of ink generally varies with a variation in type of printing medium, because of a difference in various factors, such as a blot depending upon the quantity of ink absorption. The greater dot size causes a greater overlap of the adjoining dots and makes the banding, which is due to the deviation of the dot recording positions, relatively inconspicuous. The printing medium that causes the dot created by a fixed quantity of ink to have the greater size ensures the higher recording ratio of the specific type of dot without causing any conspicuous banding. The printer of the above arrangement sets the recording ratio of the specific type of dot based on this characteristic. The specific type of dots are thus created at an appropriate recording ratio that is free from the banding, according to the size of the dot created by a fixed quantity of ink. This arrangement ensures the high-quality printing. The fixed quantity of ink may be any value that is commonly used for the purpose of comparison between various printing media, and is, for example, equal to the quantity of ink used for creating the specific type of dot.

The size of the dot created by the fixed quantity of ink is basically correlated to the quantity of ink absorption of the printing medium. The correlation is not always expressed as a linear relationship. The recording ratio of the specific type of dot may be set according to the quantity of ink absorption of the printing medium, based on the correlation. In the printer of the present invention, the size of the dot created by the fixed quantity of ink may be replaced with the quantity of ink absorption of the printing medium.

In accordance with one preferable application of the present invention, the printer further includes a unit that causes each raster line, which is an array of dots aligned in one direction on said printing medium, to be formed by a plurality of divisional scans with said head, and carries out a sub-scan that moves said printing medium relative to said head in a direction that crosses the direction of the alignment of dot in the raster line, in order to enable each raster line to be formed with different nozzles. The specified printing condition is a number of divisional scans required for forming each raster line, and the recording ratio of the specific type of dot increases with an increase in number of divisional scans.

The printer of this arrangement forms each raster line by a plurality of divisional scans with different nozzles. The structure of forming each raster line with different nozzles causes a variation in deviation of the dot recording positions on the raster line according to the characteristics of the respective nozzles. This makes the banding, which is due to the deviation of the dot recording positions, relatively inconspicuous. This is the general effect exerted in the case where each raster line is formed by a plurality of divisional scans. The increase in number of divisional scans makes the banding more inconspicuous.

The increase in number of divisional scans to complete each raster line increases the recording ratio of the specific type of dot created without causing any conspicuous banding. The printer of the above arrangement sets the recording ratio of the specific type of dot based on this characteristic. The specific type of dots are thus created at an appropriate recording ratio that is free from the banding, according to the number of divisional scans to complete each raster line. This arrangement ensures the high-quality printing.

In accordance with another preferable application of the printer, the specified printing condition is a printing resolution, and the recording ratio of the specific type of dot increases with an increase in printing resolution.

The printing resolution implies the number of pixels, where dots can be created, per unit area. In the case of a low printing resolution, the positions of recording the specific type of dot are relatively restricted and have a low degree of freedom. The degree of freedom in positions of recording the specific type of dot is heightened with an increase in printing resolution. FIG. 20 shows an example of dot recording in the case of the relatively low degree of freedom in positions of recording the specific type of dot. The closed circles represent the specific type of dots. The lattices of the broken line represent an arrangement of pixels. FIG. 21 shows an example of dot recording the case of a high resolution. The example of FIG. 21 has the pixels in the lateral direction double the number of the pixels in the example of FIG. 20.

In the case of the low resolution, the dot recording positions are limited, so that the positional relationship between the adjoining dots is relatively restricted. This increases the occurrence of the portions in which dots are aligned in a regular manner and the portions where dots face to each other in the vertical direction as shown in FIG. 20. These portions make the banding conspicuous. In the case of the high resolution, on the other hand, there is a high degree of freedom in dot recording positions. This decreases the occurrence of the portions in which dots are aligned in a regular manner and the like and reduces the occurrence of banding.

The recording ratio of the specific type of dot created without causing any conspicuous banding increases with an increase in resolution. The printer of the above arrangement sets the recording ratio of the specific type of dot based on this characteristic. The specific type of dots are thus created at an appropriate recording ratio that is free from the banding, according to the printing resolution. This arrangement ensures the high-quality printing.

In accordance with one preferable embodiment of the printer, the head enables creation of the at least two different types of dots having different sizes with inks of different densities having an identical hue, and the recording ratio of the specific type of dot is set for each ink having a different density.

The specific type of dots are thus created at an appropriate recording ratio that is free from the banding, according to the density of ink. This arrangement improves the picture quality of the resulting printed image.

In the printer of the above arrangement, it is preferable that the recording ratio of the specific type of dot increases with an increase in density of ink.

The higher-density ink is generally used for relatively high tone values, that is, for relatively dark portions in the printed image. In such dark portions, before the specific type of dots are created with the higher-density ink, a large number of dots have already been created with the lower-density ink of the same hue. Even if there is a deviation of the recording positions of the specific type of dots created with the higher-density ink, the large number of dots created with the lower-density ink of the same hue make the banding inconspicuous. In the case where the specific type of dots are created with the lower-density ink, on the other hand, the dots of the same hue have not been created previously, so that the banding is rather conspicuous.

The recording ratio of the specific type of dot created without causing any conspicuous banding increases with an increase in density of ink. The printer of the above arrangement sets the recording ratio of the specific type of dot based on this characteristic. The specific type of dots are thus created at an appropriate recording ratio that is free from the banding, according to the density of ink. This arrangement ensures the high-quality printing.

In accordance with another preferable embodiment of the printer, the head enables creation of the at least two different types of dots having different sizes with inks of different hues, and the recording ratio of the specific type of dot is set for each ink having a different hue.

The specific type of dots are thus created at an appropriate recording ratio that is free from the banding, according to the hue of ink. This arrangement improves the picture quality of the resulting printed image.

In the printer having any of the arrangements discussed above, a variety of known multi-valuing means may be applied for the decision unit that determines whether or not a certain type of dot is to be created in each pixel based on the recording ratio. The multi-valuing means may adopt the error diffusion method or the dither method.

Possible applications of the present invention other than the printer discussed above include a program that attains the above functions to drive the printer and a recording medium in which such a program is recorded. Typical examples of the recording media include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media. Still another application of the invention is a program supply apparatus that supplies a computer program, which causes a computer to attain the multi-valuing function of the printer, to the computer via a communication path.

These and other objects, features, aspects, and advantages of the present invention will become more apparent from the following detailed description of the preferred embodiment with the accompanying drawings.

DESCRIPTION OF THE PREFERRED EMBODIMENT (1) Structure of Apparatus

Figure 1:
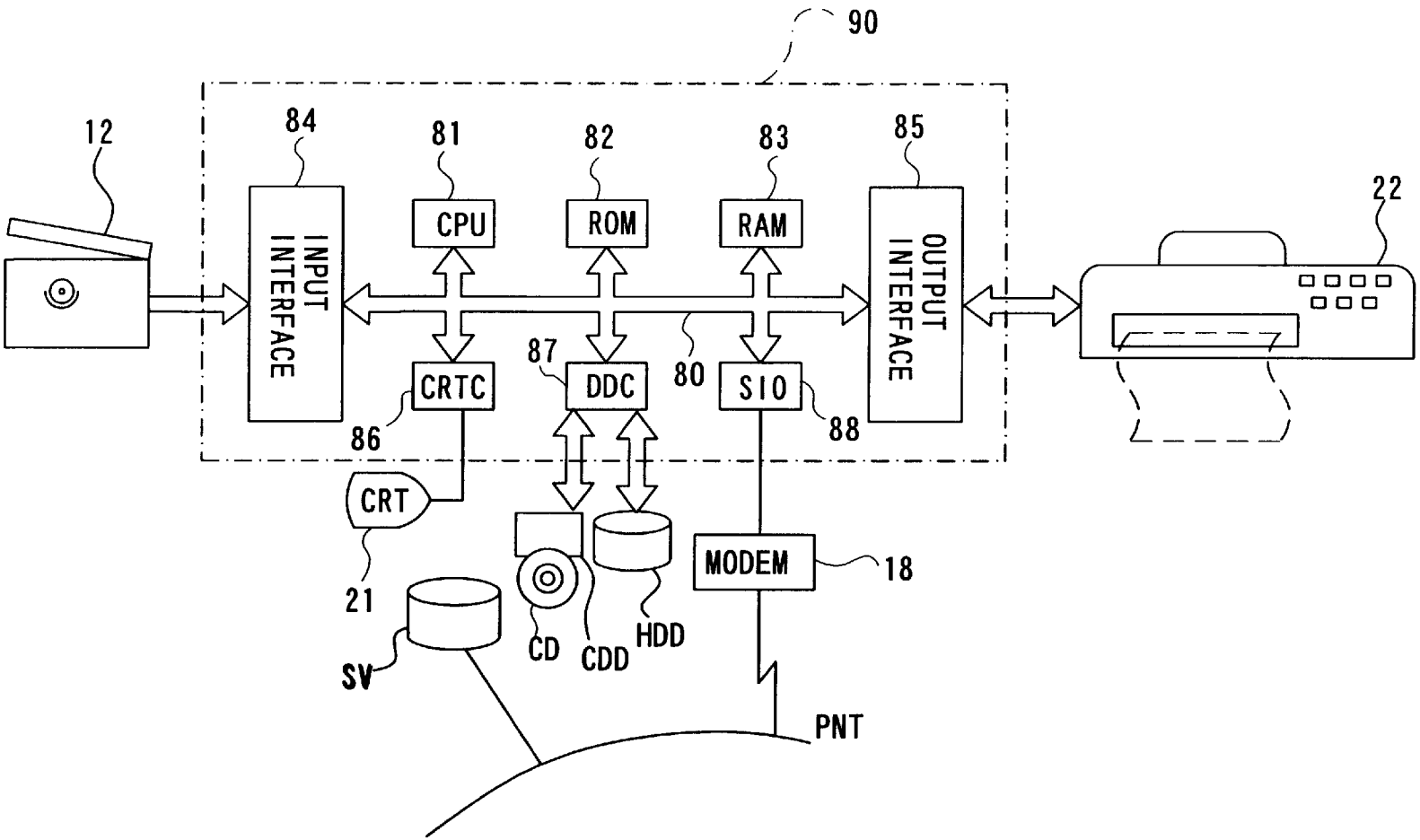
FIG. 1 is a block diagram schematically illustrating the structure of a printing system including a printer 22 as one embodiment according to the present invention.

Referring now to the drawings, wherein like reference numerals designate identical or corresponding parts throughout the several views, and more particularly to FIG. 1 thereof, the printing system includes a computer 90 connected to a scanner 12 and a color printer 22. The computer 90 reads and executes predetermined programs to function as the image processing apparatus and in combination with the printer 22 as the printing apparatus. The computer 90 includes a CPU 81, which executes a variety of operations for controlling processes relating to image processing according to the programs, and the following constituents mutually connected via a bus 80. A ROM 82 stores in advance a variety of programs and data required for the execution of the various operations by the CPU 81. A variety of programs and data required for the execution of the various operations by the CPU 81 are temporarily written in and read from a RAM 83. An input interface 84 is in charge of input of signals from the scanner 12 and a keyboard 14, whereas an output interface 85 is in charge of output of data to the printer 22. CRTC 86 controls output of signals to a color CRT display 21. A disk controller (DDC) 87 controls transmission of data to and from a hard disk 16, a flexible disk drive 15, and a CD-ROM drive (not shown). A variety of programs loaded to the RAM 83 and executed as well as a variety of other programs provided in the form of a device driver are stored in the hard disk 16.

A serial input-output interface (SIO) 88 is also connected to the bus 80. The SIO 88 is connected to a modem 18 and further to a public telephone network PNT via the modem 18. The computer 90 is connected with an external network via the SIO 88 and the model 18 and may gain access to a specific server SV to download the programs required for the image processing into the hard disk 16. Another possible application reads the required programs from a flexible disk FD or a CD-ROM and causes the computer 90 to execute the input programs.

Figure 2:
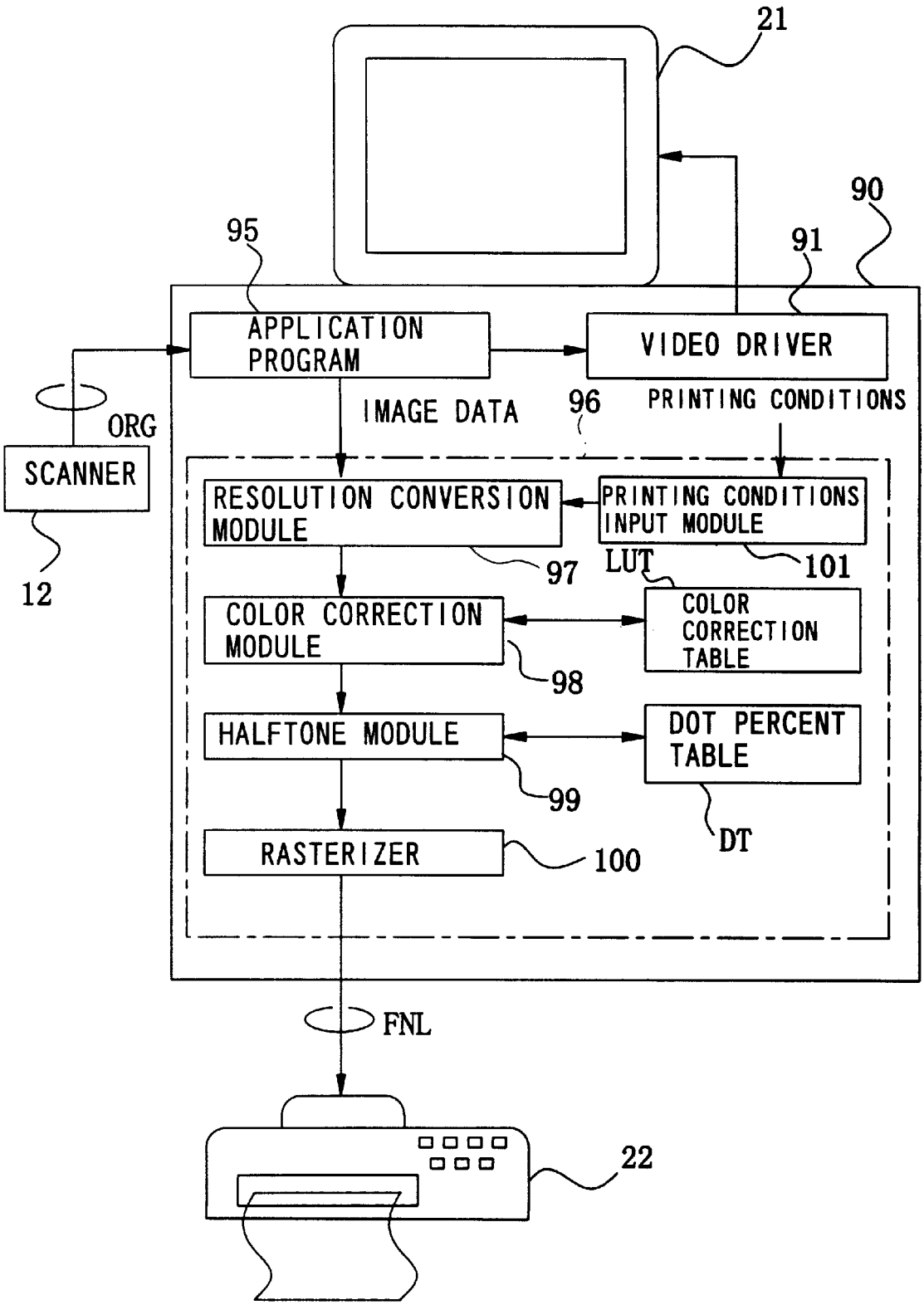
FIG. 2 is a block diagram illustrating a software configuration of the printing system.

FIG. 2 is a block diagram illustrating a software configuration of the printing system. The computer 90 executes an application program 95 under a specific operating system. A video driver 91 and a printer driver 96 are incorporated in the operating system. Image data are output from the application program 95 via the printer driver 96 to be transferred to the printer 22. The application program 95, which implements required image processing, such as retouching of images, reads an image from the scanner 12, causes the input image to be subjected to the required image processing, and displays the processed image on the CRT display 21 via the video driver 91. The scanner 12 reads color image data from a color original and outputs the color image data as original color image data ORG, which consists of three color components, red (R), green (G), and blue (B), to the application program 95.

When the application program 95 issues an instruction of printing, the printer driver 96 in the computer 90 receives the image data from the application program 95 and converts the input image data into signals processible by the printer 22 (in this embodiment, multi-value signals with respect to four colors, cyan, magenta, yellow, and black). In the example of FIG. 2, the printer driver 96 includes a resolution conversion module 97, a color correction module 98, a color correction table LUT, a halftone module 99, a rasterizer 100, and a printing conditions input module 101.

The printing conditions input module 101 inputs printing conditions specified by the user through operations of the keyboard 14 and a mouse (not shown). The input conditions are sent to the resolution conversion module 97 and used as parameters for specifying the details of the respective processes executed by the respective modules in the printer driver 96 as discussed later. The printing conditions that may be specified by the user include a specification of whether or not color printing is performed and a specification of execution or non-execution of printing according to the overlap method. The printing by the overlap method forms each raster line by two or more main scans as is known to the ordinary skilled in the art. By way of example, in the configuration of printing each raster line by two main scans, a first main scan prints odd pixels on each raster line with some nozzles and a second main scan prints even pixels on the same raster line with different nozzles. In the description hereinafter, the number of main scans required for forming each raster line is referred to as the number of passes.

The resolution conversion module 97 converts the resolution of the color image data processed by the application program 95, that is, the number of pixels per unit length, into the resolution processible by the printer driver 96. The image data with the converted resolution are still image information consisting of three color components, R, G, and B. The color correction module 98 refers to the color correction table LUT and further converts the resolution-converted image data with respect to each pixel into color data cyan (C), magenta (M), yellow (Y), and black (K) printable by the printer 22. When a printing condition representing non-execution of color printing is specified by the user, the procedure omits this color correction process.

The color correction data have tone values, for example, in the range of 256 tones. The halftone module 99 carries out a halftone process to create dots in a dispersed manner and enables the expression of the specified tone values by the printer 22. The printer 22 of this embodiment is a multi-value printer that enables creation of dots having both a greater size and a smaller size with a higher-density ink and a lower-density ink as discussed later. The halftone module 99 refers to a dot percent table DT, sets dot recording ratios or dot percents of the respective sizes according to the tone values of the image data and the printing conditions, and implements the halftone processing to attain the dot percents. The processed image data are rearranged by the rasterizer 100 to a sequence of data to be transferred to the printer 22 and output as final image data FNL. In this embodiment, the printer 22 only plays a role of creating dots based on the image data FNL and does not carry out the image processing. In accordance with an alternative application, the printer 22 may, however, carry out the image processing as well as the creation of dots.

Figure 3:
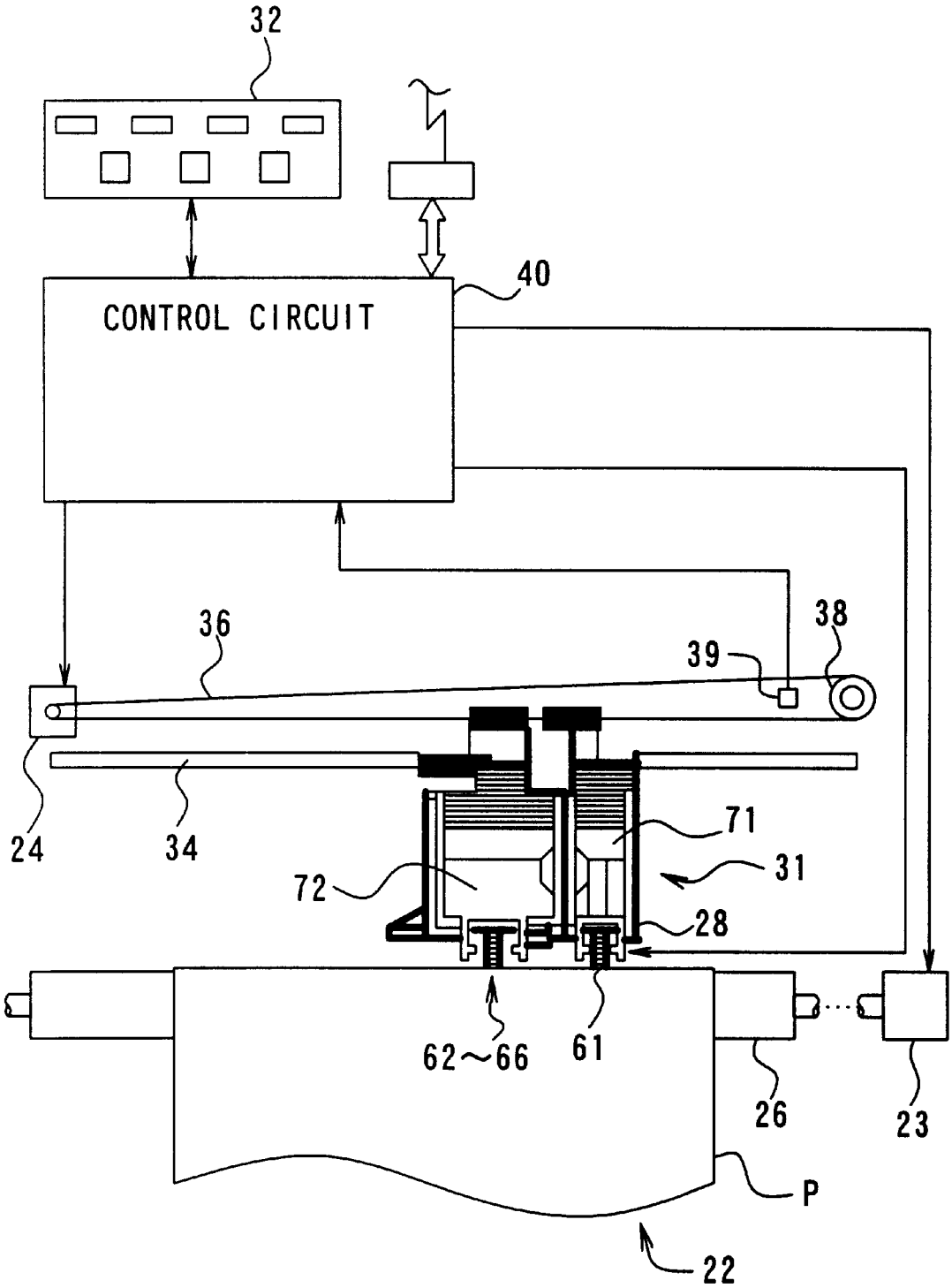
FIG. 3 schematically illustrates the structure of the printer 22.

The schematic structure of the printer 22 used in this embodiment is described with the drawing of FIG. 3. As illustrated in FIG. 3, the printer 22 has a mechanism for causing a sheet feed motor 23 to feed a sheet of printing paper P, a mechanism for causing a carriage motor 24 to move a carriage 31 forward and backward along an axis of a platen 26, a mechanism for driving a print head 28 mounted on the carriage 31 to control the ejection of ink and creation of dots, and a control circuit 40 that controls transmission of signals to and from the sheet feed motor 23, the carriage motor 24, the print head 28, and a control panel 32.

The mechanism for reciprocating the carriage 31 along the axis of the platen 26 includes a sliding shaft 34 arranged in parallel with the axis of the platen 26 for slidably supporting the carriage 31, a pulley 38, an endless drive belt 36 spanned between the carriage motor 24 and the pulley 38, and a position sensor 39 that detects the position of the origin of the carriage 31.

A black ink cartridge 71 for black ink (Bk) and a color ink cartridge 72 in which five color inks, that is, cyan (C1), light cyan (C2), magenta (M1), light magenta (M2), and yellow (Y), are accommodated may be mounted on the carriage 31 of the printer 22. A total of six ink ejection heads 61 through 66 are formed on the print head 28 that is disposed in the lower portion of the carriage 31, and ink supply conduits 67 (see FIG. 4) are arranged upright in the bottom portion of the carriage 31 for leading supplies of inks from ink tanks to the respective ink ejection heads 61 through 66. When the black ink cartridge 71 and the color ink cartridge 72 are attached downward to the carriage 31, the ink supply conduits 67 are inserted into connection apertures (not shown) formed in the respective ink cartridges 71 and 72. This enables supplies of inks to be fed from the respective ink cartridges 71 and 72 to the ink ejection heads 61 through 66.

Figure 4:
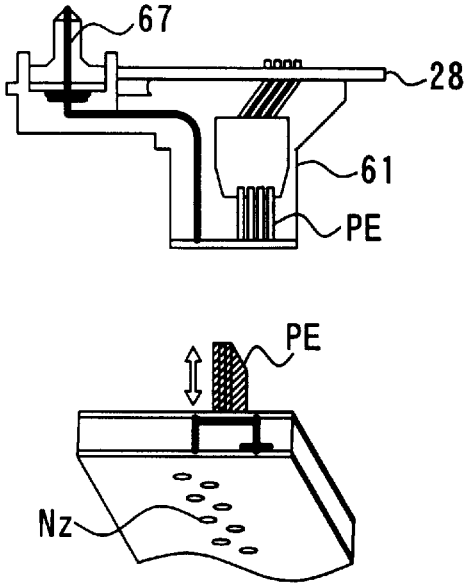
FIG. 4 schematically illustrates the internal structure of a print head in the printer 22.

The following briefly describes the mechanism of ejecting ink and creating dots. FIG. 4 schematically illustrates the internal structure of the print head 28. When the ink cartridges 71 and 72 are attached to the carriage 31, supplies of inks in the ink cartridges 71 and 72 are sucked out by capillarity through the ink supply conduits 67 and are led to the ink ejection heads 61 through 66 formed in the print head 28 arranged in the lower portion of the carriage 31 as shown in FIG. 4. In the event that the ink cartridges 71 and 72 are attached to the carriage 31 for the first time, a pump works to suck first supplies of inks into the respective ink ejection heads 61 through 66. In this embodiment, the structure of the pump for suction and a cap for covering the print head 28 during the suction is not illustrated nor described specifically.

Figure 5:
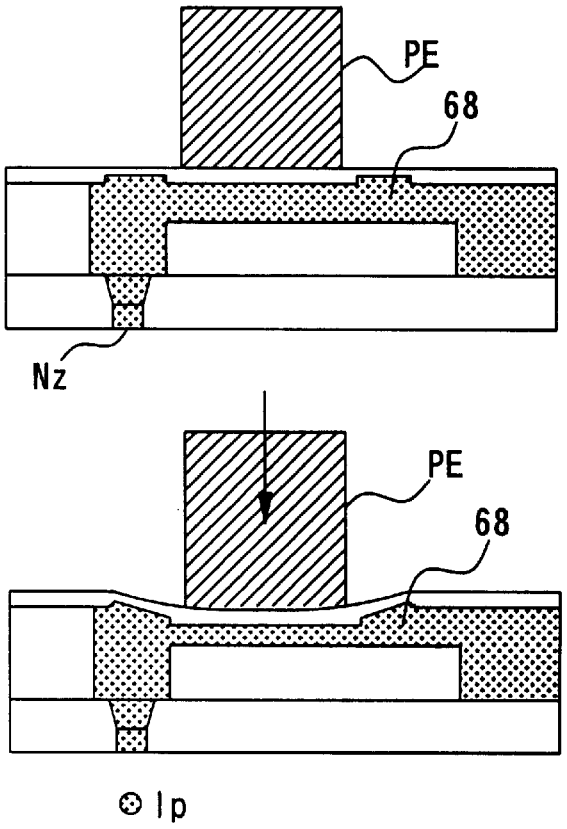
FIG. 5 shows the principle of dot creation in the printer 22.

An array of forty-eight nozzles Nz (see FIG. 6) is formed in each of the ink ejection heads 61 through 66 as discussed later. A piezoelectric element PE, which is one of electrically distorting elements and has an excellent response, is arranged for each nozzle Nz. FIG. 5 illustrates a configuration of the piezoelectric element PE and the nozzle Nz. As shown in the upper drawing of FIG. 5, the piezoelectric element PE is disposed at a position that comes into contact with an ink conduit 68 for leading ink to the nozzle Nz. As is known by those skilled in the art, the piezoelectric element PE has a crystal structure that is subjected to mechanical stress due to application of a voltage and thereby carries out extremely high-speed conversion of electrical energy into mechanical energy. In this embodiment, application of a voltage between electrodes on both ends of the piezoelectric element PE for a predetermined time period causes the piezoelectric element PE to extend for the predetermined time period and deform one side wall of the ink conduit 68 as shown in the lower drawing of FIG. 5. The volume of the ink conduit 68 is reduced with an extension of the piezoelectric element PE, and a certain amount of ink corresponding to the reduced volume is sprayed as an ink particle Ip from the end of the nozzle Nz at a high speed. The ink particles Ip soak into the sheet of paper P set on the platen 26, so as to implement printing.

Figure 6:
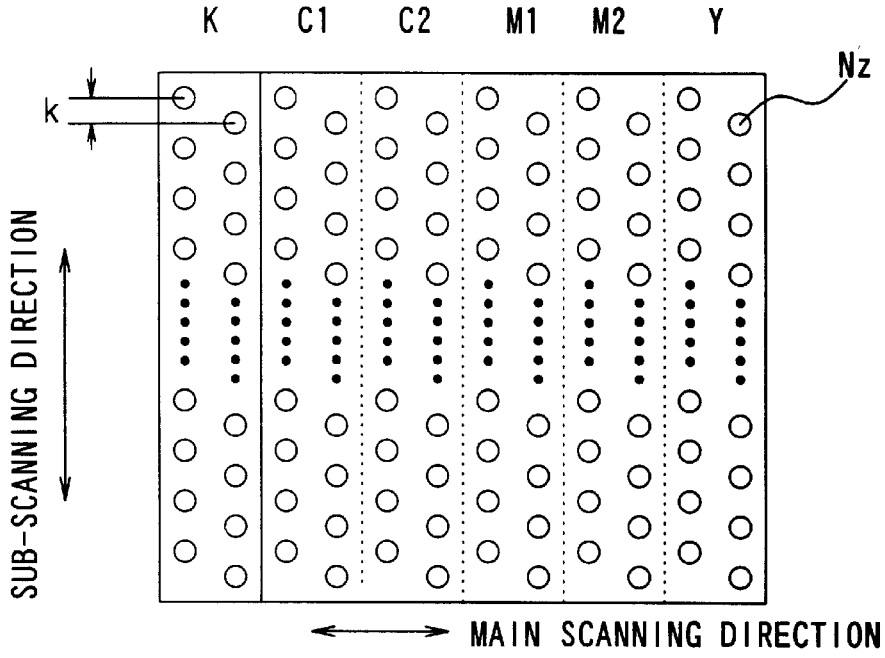
FIG. 6 shows an arrangement of nozzles in the printer 22.

FIG. 6 shows an arrangement of the ink jet nozzles Nz in each of the ink ejection heads 61 through 66. The arrangement of nozzles shown in FIG. 6 includes six nozzle arrays, wherein each nozzle array ejects ink of each color and includes forty-eight nozzles Nz arranged in zigzag at a fixed nozzle pitch k. The positions of the nozzles in the sub-scanning direction are identical in the respective nozzle arrays. The forty-eight nozzles Nz included in each nozzle array may be arranged in alignment, instead of in zigzag. The zigzag arrangement shown in FIG. 6, however, allows a small value to be set to the nozzle pitch k in the manufacturing process.

Figure 7:
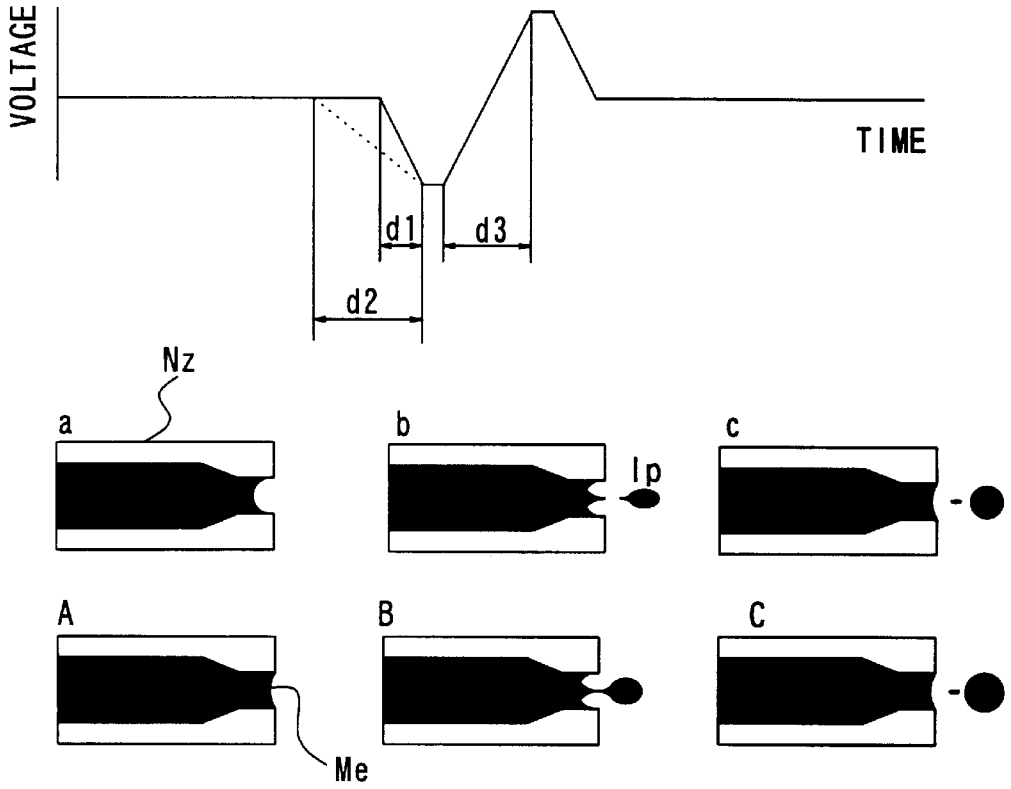
FIG. 7 shows the principle of creating dots having different dot sizes in the printer 22.

The printer 22 can create three different types of dots having different dot sizes with the nozzles Nz of a fixed diameter shown in FIG. 6. The following describes the principle of such dot creation technique. FIG. 7 shows the relationship between the driving waveform of the nozzle Nz and the size of the ink particle Ip ejected from the nozzle Nz. The driving waveform shown by the broken line in FIG. 7 is used to create standard-sized dots. A decrease in voltage applied to the piezoelectric element PE in a division d2 deforms the piezoelectric element PE in the direction of increasing the cross section of the ink conduit 68, contrary to the case discussed previously with the drawing of FIG. 5. Due to the restriction of the supply rate of ink through the ink supply conduit 67, the quantity of ink supply becomes insufficient relative to the expansion of the ink conduit 68.

As shown in a state A of FIG. 7, an ink interface Me, which is generally referred to as meniscus, is thus slightly concaved inward the nozzle Nz. When the driving waveform shown by the solid line in FIG. 7 is used to abruptly lower the voltage in a division d1, on the other hand, the quantity of ink supply becomes more insufficient. The meniscus is thus more significantly concaved inward the nozzle Nz as shown in a state 'a', compared with the state A. A subsequent increase in voltage applied to the piezoelectric element PE in a division d3 causes the ink to be ejected, based on the principle described previously with the drawing of FIG. 5. As shown in states B and C, a large ink droplet is ejected when the meniscus is only slightly concaved inward (state A). As shown in states 'b' and 'c', on the other hand, a small ink droplet is ejected when the meniscus is significantly concaved inward (state 'a').

Figure 8:
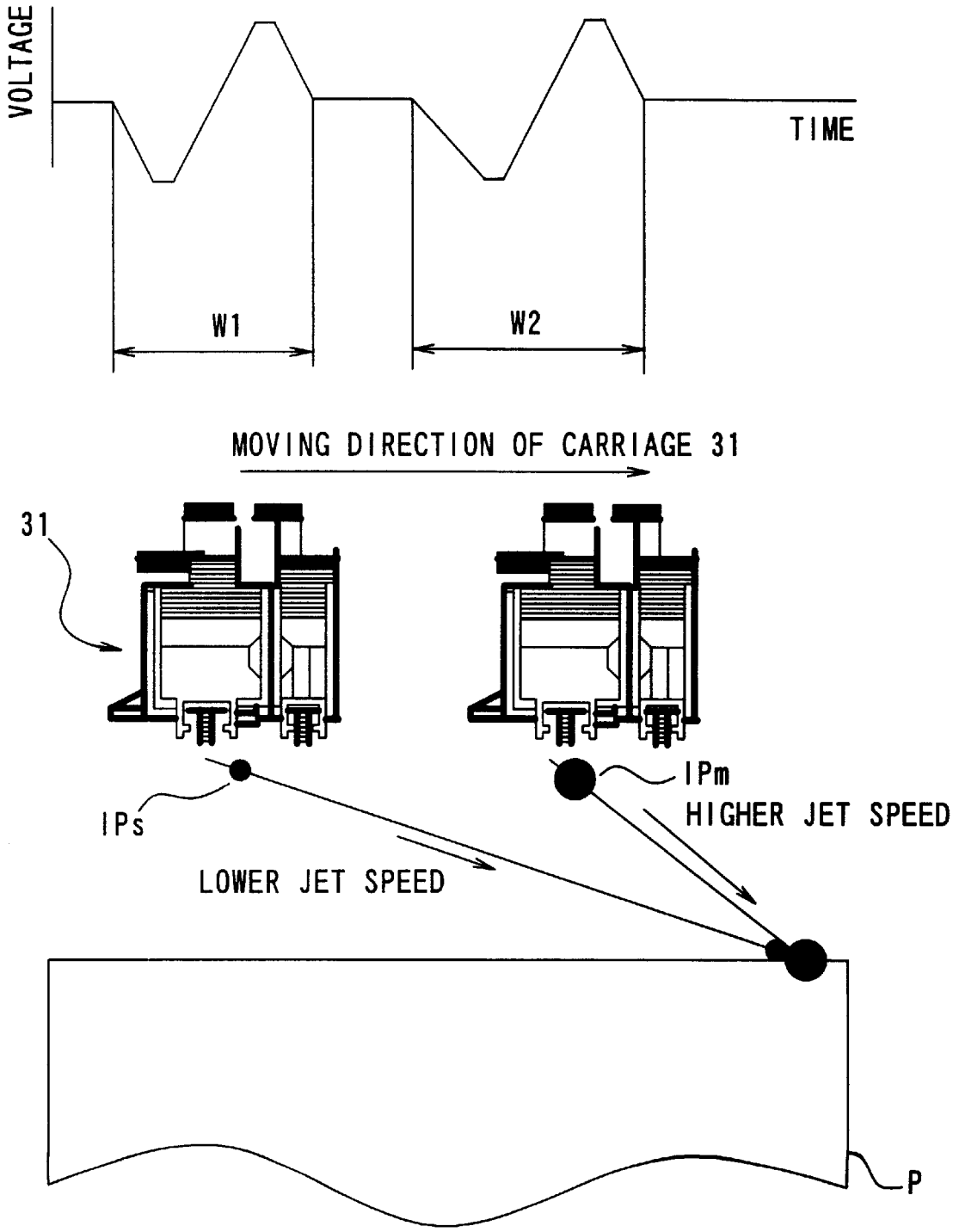
FIG. 8 shows driving waveforms of nozzles in the printer 22 and dots created in response to the driving waveforms.

Based on the above principle, the dot size may be varied according to the rate of change in the divisions d1 and d2 where the driving voltage applied to the piezoelectric element PE is lowered. This embodiment provides two different driving waveforms, that is, one for creating small dots IP1 having the smallest size and the other for creating medium dots IP2 having the intermediate size, based on the relationship between the driving waveform and the dot size. FIG. 8 shows driving waveforms used in this embodiment. A driving waveform W1 is used to create the small dots IP1, whereas a driving waveform W2 is used to create the medium dots IP2. These two driving waveforms enable two different types of dots having different dot sizes, that is, the small dot and the medium dot, to be created with the nozzles Nz of an identical size. In the printer 22 of this embodiment, these driving waveforms are consecutively and periodically output in the sequence of W1 and W2 accompanied with the movement of the carriage 31.

Large dots are created by using both the driving waveforms W1 and W2 shown in FIG. 8. The lower part of FIG. 8 shows the process of hitting an ink droplet IPs for the small dot and an ink droplet IPm for the medium dot ejected from the nozzle against the printing paper P. When both the small dot and the medium dot are created in response to the driving waveforms of FIG. 8, a greater quantity of ink is supplied to the ink conduit 68 in the case of creation of the medium dot than in the case of creation of the small dot as clearly understood from the states of the meniscus shown in FIG. 7. The ink droplet IPm for the medium dot accordingly has a higher jet than the ink droplet IPs for the small dot. Namely there is a difference in jet speed between these two types of ink droplets. Regulation of the scanning speed of the carriage 31 in the main scanning direction and the timings for successively ejecting the ink droplet IPs for the small dot and the ink droplet IPm for the medium dot according to the distance between the carriage 31 and the printing paper P enables both the ink droplets to reach the printing paper P at a substantially identical timing. In this manner, the embodiment creates a large dot having the greatest dot size with the two driving waveforms shown in the upper part of FIG. 8.

In this embodiment, only the two types of dots, the large dot and the small dot, are used for printing among the three different types of dots, for the simplicity of the control. All the three different types of dots may, however, be used for printing images. The size of the small dot is substantially equal to the recording pitch of dots in the sub-scanning direction in this embodiment. As clearly shown in FIG. 15, the size of the small dot is substantially equal to but more precisely, very slightly greater than the length of one side of each pixel.

Figure 9:
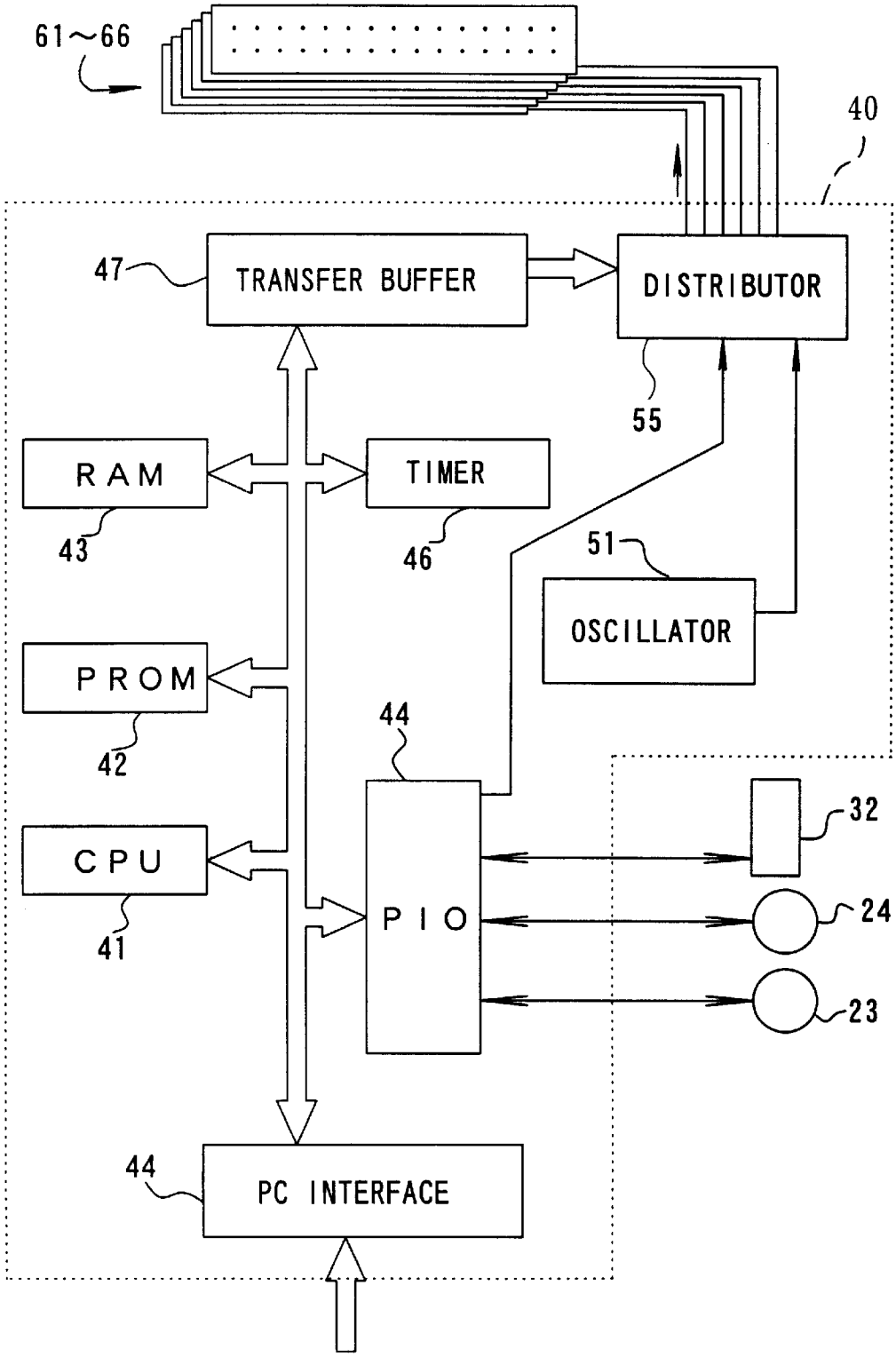
FIG. 9 is a block diagram schematically illustrating the internal structure of the printer 22.

The following describes the internal structure of the control circuit 40 in the printer 22 and the method of driving the print head 28 with the plurality of nozzles Nz arranged as shown in FIG. 6 in response to the driving waveforms discussed above. FIG. 9 illustrates the internal structure of the control circuit 40. The control circuit 40 includes a CPU 41, a PROM 42, a RAM 43, a PC interface 44 that transmits data to and from the computer 90, a peripheral equipment input-output unit (PIO) 45 that transmits signals to and from the peripheral equipment, such as the sheet feed motor 23, the carriage motor 24, and the control panel 32, a timer 46 that counts the time, and a drive buffer 47 that outputs dot on-off signals to the ink ejection heads 61 through 66. These elements and circuits are mutually connected via a bus 48. The control circuit 40 further includes an oscillator 51 that outputs driving waveforms at selected frequencies (see FIG. 8) and a distributor 55 that distributes the outputs from the oscillator 51 to the ink ejection heads 61 through 66 at selected timings. The control circuit 40 receives dot data processed by the computer 90, temporarily stores the processed dot data in the RAM 43, and outputs the dot data to the drive buffer 47 at a preset timing.

Each nozzle array on one of the ink ejection heads 61 through 66 is arranged in a circuit that includes the drive buffer 47 as the source and the distributor 55 as the sink. The piezoelectric elements PE corresponding to the nozzles included in the nozzle array have one electrodes respectively connected to the output terminals of the drive buffer 47 and the other electrodes collectively connected to the output terminal of the distributor 55. The driving waveforms of the oscillator 51 are output from the distributor 55. When the CPU 41 outputs the dot on/off signals of the respective nozzles to the terminals of the drive buffer 47, only the piezoelectric elements PE receiving the ON signal from the drive buffer 47 are driven in response to the output driving waveforms. The ink particles Ip are thus ejected from the nozzles corresponding to the piezoelectric elements PE that have received the ON signal from the drive buffer 47. The voltage as the driving waveform is applied to the piezoelectric elements corresponding to all the nozzles, irrespective of creation or non-creation of dots. Regulation of the voltage output from the drive buffer 47 with regard to each nozzle controls the effectiveness or ineffectiveness of the driving waveform for each nozzle.

The ink ejection heads 61 through 66 are arranged in the moving direction of the carriage 31 as shown in FIG. 6, so that the respective nozzle arrays reach a specific position on the printing paper P at different timings. Although not being illustrated, a delay circuit is mounted on the output side of the distributor 55. The driving waveform is output at a specific timing that aligns the positions of dots in the main scanning direction formed by the respective nozzles according to the positional difference between the corresponding nozzles included in the ink ejection heads 61 through 66 and the scanning speed of the carriage 31. The CPU 41 accordingly outputs the dot on-off signals at required timings via the drive buffer 47 to create the dots of the respective colors by taking into account the positional difference between the corresponding nozzles included in the ink ejection heads 61 through 66. The CPU 41 also controls the output of the dot on-off signals by considering the two-line arrangement of each nozzle array on each of the ink ejection heads 61 through 66 as shown in FIG. 6.

In the printer 22 of the embodiment having the hardware structure discussed above, while the sheet feed motor 23 feeds the sheet of paper P (hereinafter referred to as the sub-scan), the carriage motor 24 drives and reciprocates the carriage 31 (hereinafter referred to as the main scan), simultaneously with actuation of the piezoelectric elements PE on the respective ink ejection heads 61 through 66 of the print head 28. The printer 22 accordingly sprays the respective color inks to create dots and thereby forms a multi-color image on the sheet of paper P.

In this embodiment, the printer 22 has the head that uses the piezoelectric elements PE to eject ink as discussed previously. The printer may, however, adopt another technique for ejecting ink. One alternative structure of the printer supplies electricity to a heater installed in an ink conduit and utilizes the bubbles generated in the ink conduit to eject ink.

(2) Control of Dot Creation

Figure 10:
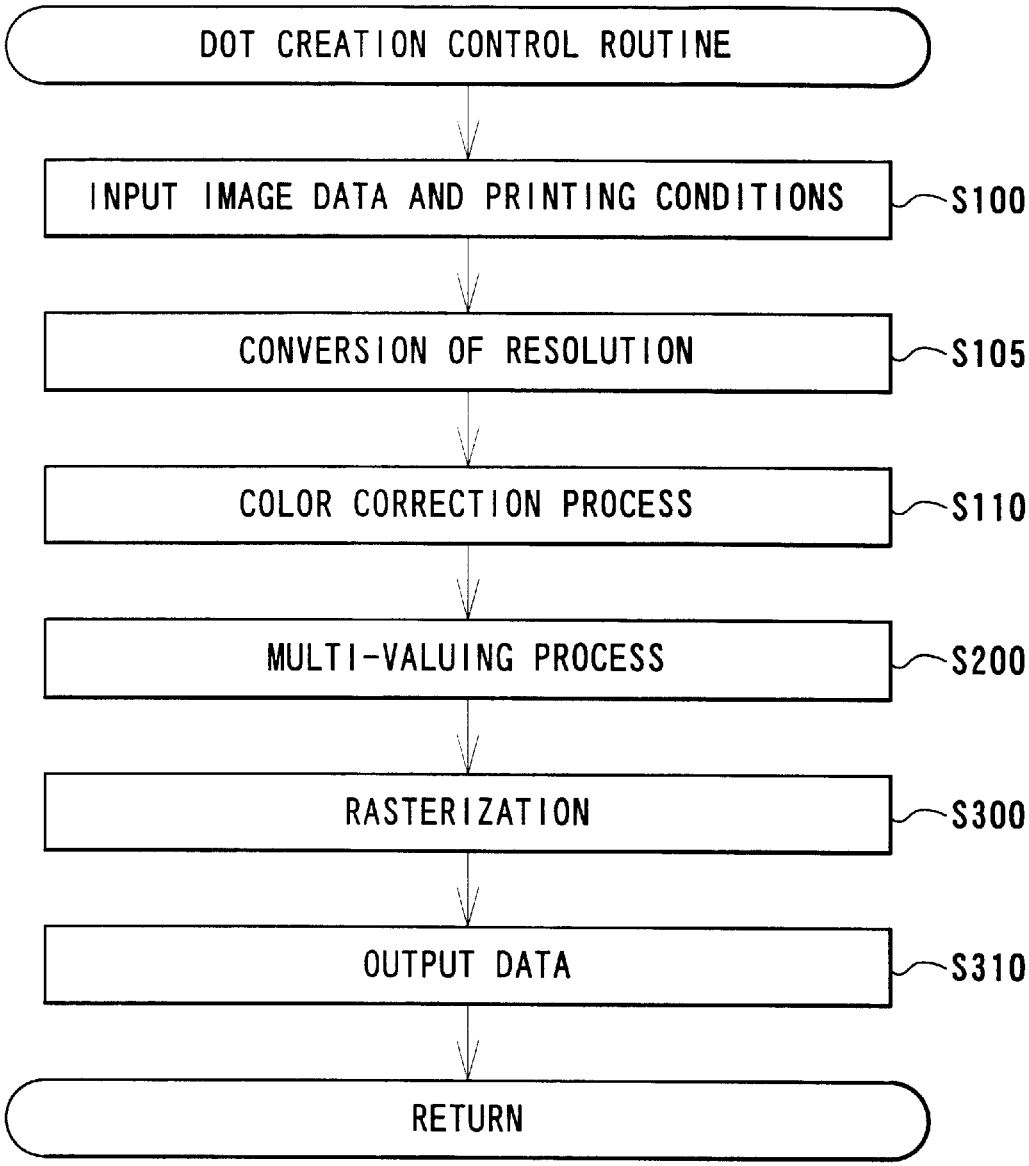
FIG. 10 is a flowchart showing a dot creation control routine.

FIG. 10 is a flowchart showing a dot creation control routine executed in this embodiment. The dot creation control routine is carried out by the CPU 81 of the computer 90.

When the program enters the routine, the CPU 81 first inputs image data and specified printing conditions at step S100. The image data input here are transmitted from the application program 95 shown in FIG. 2 and have 256 tone values in the range of 0 to 255 with regard to the colors R, G, and B for the respective pixels included in an image. The resolution of image data is varied, for example, with a variation in resolution of the original image data ORG. The printing conditions include the type of printing paper, the specification of whether or not color printing is carried out, and the specification of execution or non-execution of printing according to the overlap method.

The CPU 81 then converts the resolution of the input image data into the printing resolution of the printer 22 at step S105. In the case where the resolution of the image data is lower than the printing resolution, linear interpolation is applied to create a new piece of data between adjoining pieces of the existing original image data and thereby implement conversion of the resolution. In the event that the resolution of the image data is higher than the printing resolution, on the contrary, existing pieces of the original image data are skipped at a certain ratio, for the purpose of conversion of the resolution. The process of converting the resolution is not essential in this embodiment, and printing may be carried out without the conversion of the resolution.

The CPU 81 subsequently carries out a color correction process at step S110. The color correction process converts image data consisting of the tone values of R, G, and B into data consisting of the tone values of C, M, Y, and K, which are colors used in the printer 22. The color correction process refers to the color correction table LUT (see FIG. 2), which stores a combination of C, M, Y, and K that enables the printer 22 to express the color specified by each combination of R, G, and B. A variety of known techniques are applicable to the color correction process using the color correction table LUT. For example, the interpolation technique may be applied for the color correction process.

The CPU 81 causes the color-corrected image data to be subjected to a multi-valuing process at step S200. The multi-valuing process converts the tone value of the original image data (expressed by 256 tones in this embodiment) into the tone value expressible by the printer 22 with regard to each pixel. As discussed later, the multi-valuing process carried out in this embodiment converts 256 tones into 3 tones, 'creation of no dot', 'creation of a small dot', and 'creation of a large dot'. The multi-valuing process may, however, implement conversion into a greater number of tones. The details of the multi-valuing process executed in this embodiment are described with the flowchart of FIG. 11.

When the program enters the multi-valuing process, the CPU 81 first inputs image data CD and printing conditions at step S210. The image data CD input here have been subjected to the color correction (step S110 in the flowchart of FIG. 10) and have the tone values expressed by 256 tones with regard to the colors C, M, Y, and K for each pixel.

Figure 12A:
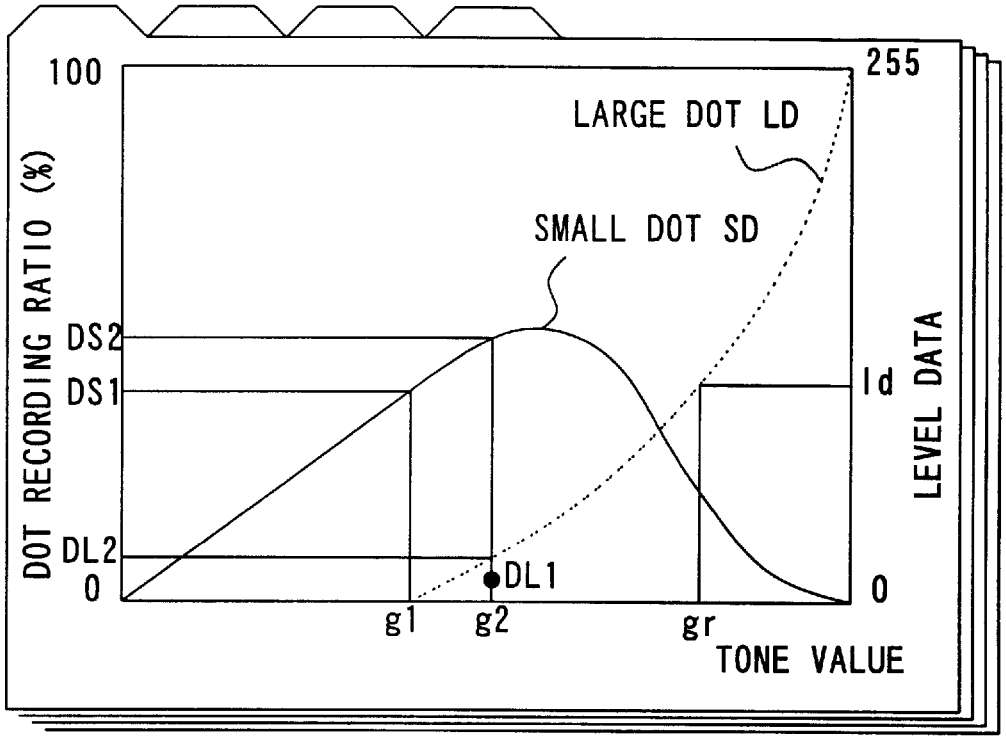
FIGS. 12A and 12B show examples of dot percent tables DT.

The process sets level data LVL of the large dot with respect to the input image data CD at step S220. The procedure of setting the level data LVL of the large dot is described with the drawings of FIGS. 12A and 12B. FIG. 12A is a graph showing the recording ratios of the large dot and the small dot plotted against the tone value. In the graph of FIG. 12A, a curve SD shown by the solid line represents the recording ratio of the small dot and a curve LD shown by the dotted line represents the recording ratio of the large dot. The dot recording ratio implies the ratio of dots created in a solid area having a fixed tone value to pixels included in the solid area.

The level data LVL are obtained by converting the dot recording ratios into 256 level values in the range of 0 to 255. The process of step S220 reads the level data LVL corresponding to the tone values of the input image data CD from the curve LD. When the tone value of the image data CD is equal to gr as shown in FIG. 12A, for example, the level data LVL is read to be ld from the curve LD. The actual procedure stores the curve LD in advance as a one-dimensional table into the ROM 82 and refers to the table to determine the level data LVL. This one-dimensional table corresponds to the dot percent table DT shown in FIG. 1.

Figure 12B:
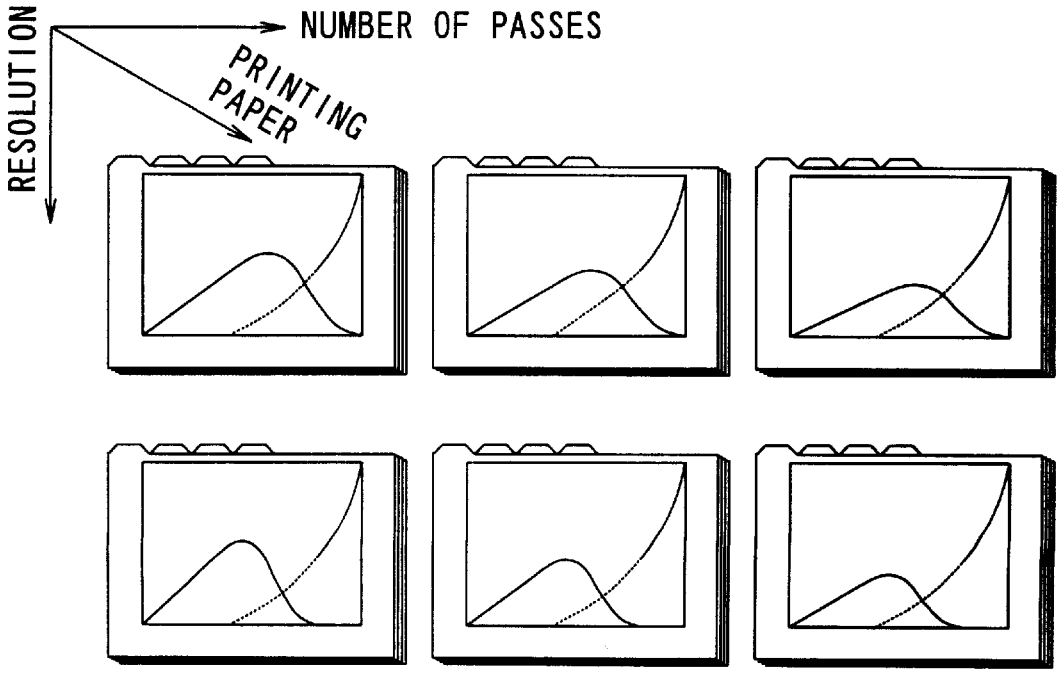

This embodiment provides different tables for the six different color inks and for the respective combinations of printing conditions. FIG. 12B shows an image of arrangement of the tables provided for each color ink in this embodiment. There are four options of the printing paper, and four tables are thereby provided according to the four options of the printing paper. In a similar manner, there are two options of the printing resolution, and two tables are provided according to the two options of the printing resolution. There are three options of the number of main scans required for formation of each raster line, that is, the number of passes, and three tables are provided according to the three options of the number of passes. The printing conditions are specified by each combination of these options. Namely a total of 24 (4×2×3) different types of dot percent tables DT are provided in this embodiment. The process of step S220 sets the level data LVL using the table that corresponds to the printing conditions input at step S210 and is selected among these 24 different dot percent tables DT. The relationship between the printing conditions and the dot recording ratio will be discussed later.

The level data LVL of the large dot set in the above manner is compared with a threshold value THL with respect to each pixel at step S230. The process of step S230 accordingly determines the on-off state of the large dot in each pixel by the dither method. Different threshold values THL are set for the respective pixels according to a dither matrix. This embodiment uses a blue noise matrix where the values of 0 to 255 appear in the pixels included in a 16×16 square.

Figures 13, 14:
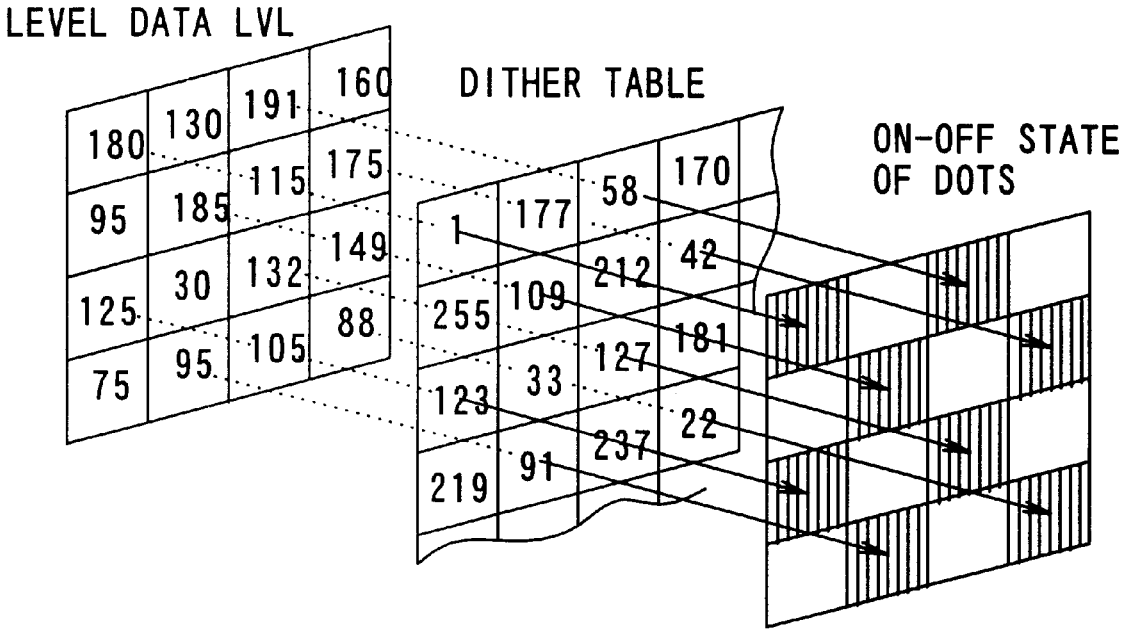
FIG. 13 shows the concept of determining the on-off state of dots by the dither method.
FIG. 14 shows a dither matrix used for determination of the on-off state of the large dot and a dither matrix used for determination of the on-of state of the small dot.

FIG. 13 shows the concept of determining the on-off state of dots by the dither method. The process compares the level data LVL of the respective pixels with the corresponding threshold values THL in the dither table. When the level data LVL is greater than the threshold value THL of the dither table in a certain pixel, the dot is set in the on state in the pixel. When the level data LVL is not greater than the threshold value THL in a certain pixel, on the other hand, the dot is set in the off state in the pixel. The hatched pixels in FIG. 13 represent the pixels in which the dot is set in the on state.

In the case where the level data LVL of the large dot is greater than the threshold value THL in a certain pixel at step S230, the program determines that the large dot is to be created in the pixel. The CPU 81 accordingly sets a binary number 11 to a variable RE that represents a resulting value at step S280. The respective bits in the resulting value RE correspond to the on-off conditions of the driving waveforms W1 and W2 shown in FIG. 8. When the resulting value RE equal to 11 is transferred to the drive buffer 47, the printer 22 ejects ink droplets in response to both the driving waveforms W1 and W2 to create a large dot.

In the case where the level data LVL of the large dot is not greater than the threshold value THL in a certain pixel at step S230, on the other hand, the program determines that the large dot is not to be created in the pixel. The CPU 81 accordingly proceeds to step S240 to set level data LVS of the small dot. The level data LVS of the small dot are read from the dot percent table DT shown in FIG. 12 according to the tone values and the printing conditions. The procedure of setting the level data LVS of the small dot is identical with that of setting the level data LVL of the large dot.

The process then compares the level data LVS of the small dot with a threshold value THS to determine the on-off state of the small dot in each pixel at step S250. While the same process as that for the large dot is applied to determine the on-off state of the small dot, the threshold values THS used for the determination with regard to the small dot are different from the threshold values THL used for the determination with regard to the large dot.

In the event that the same dither matrix is used to determine the on-off state of both the large dot and the small dot, the pixels that are probably set in the on state with regard to the large dot often coincide with those with regard to the small dot. Namely when the large dot is set in the off state in a certain pixel, it is highly probable that the small dot is also set in the off state in the same pixel. This may result in undesirably making the actual recording ratio of the small dot lower than a desired recording ratio. In order to avoid this problem, the procedure of this embodiment uses the different dither matrixes for the large dot and the small dot. This makes the positions of the pixels that are probably set in the on state with regard to the large dot different from those with regard to the small dot, thereby ensuring creation of both the large dot and the small dot in an appropriate manner. This embodiment uses a dither matrix TM shown in FIG. 14 for the large dot and another dither matrix UM, which is obtained by symmetrically shifting the respective threshold values or elements of the dither matrix TM in the sub-scanning direction as shown in FIG. 14, for the small dot. Although 4×4 matrixes are shown in FIG. 14 for convenience of illustration, the procedure of this embodiment actually uses 64×64 matrixes as mentioned previously. In accordance with another possible application, completely different dither matrixes may be used for the large dot and the small dot.

In the case where the level data LVS of the small dot is greater than the threshold value THS in a certain pixel at step S250, the program determines that the small dot is to be created in the pixel. The CPU 81 accordingly sets a binary number 10 to the resulting value RE at step S270. When the resulting value RE equal to 10 is transferred to the drive buffer 47, the driving waveform W2 is masked and the printer ejects an ink droplet in response to only the driving waveform W1 shown in FIG. 8 and thereby creates a small dot. In the case where the level data LVS of the small dot is not greater than the threshold value THS in a certain pixel at step S250, on the other hand, the program determines that the small dot is not to be created in the pixel. The CPU 81 accordingly sets a binary number 00 to the resulting value RE at step S260. When the resulting value RE equal to 00 is transferred to the drive buffer 47, both the driving waveforms W1 and W2 are masked and the printer 22 does not create any dot.

The above procedure determines which type of the dot is to be created in each pixel. The CPU 81 repeats the processing of steps S220 through S280 until the processing is completed for all the pixels at step S290. When the processing has been concluded for all the pixels, the program exits from the multi-valuing process shown in the flowchart of FIG. 11 and returns to the dot creation control routine shown in the flowchart of FIG. 10.

Referring back to the flowchart of FIG. 10, the CPU 81 carries out rasterization at stop S300. The rasterization rearranges data for one raster line in a sequence of data transfer to the print head 28 of the printer 22. There are a variety of recording modes, in which the printer 22 forms raster lines. In the simplest mode, all the dots included in each raster line are created by one main scan of the print head 28 in the forward direction. In this case, the data for one raster line are output to the print head 28 in the sequence of the processing. Another possible mode is the overlap mode. In the overlap mode, for example, the first main scan creates alternate dots in each raster line, and the second main scan creates the residual dots in the raster line. In this case, each raster lines if formed by two main scans. When the overlap mode is applied for recording, it is required to pick up the alternate dots in each raster line and transfer the corresponding data to the print head 28. The rasterization of step S300 accordingly creates the dots to be transferred to the print head 28 according to the recording method adopted in the printer 22. The detailed process of the rasterization is specified corresponding to the printing conditions input at step S100. After the rasterization, the CPU 81 outputs the data, which are printable by the printer 22, to the printer 22 at step S310. The printer 22 receives the transferred data and creates the corresponding dots in the respective pixels to print an image.

Figure 15:
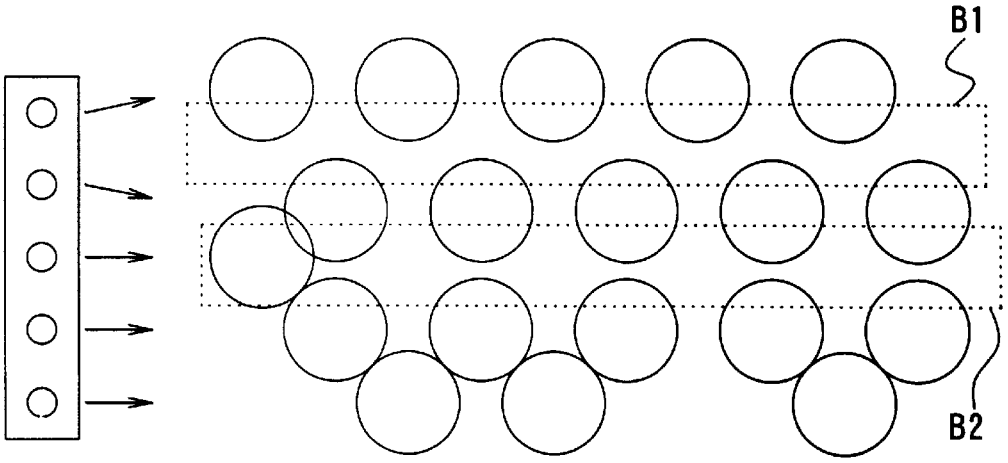
FIG. 15 shows a state of recording small dots at a first dot recording ratio.

The following describes the process of setting the dot recording ratio in this embodiment. The recording ratios of the small dot and the large dot are set to express the respective tone values by taking into account the possible occurrence of banding. FIG. 15 shows a state of dot creation at a certain recording ratio. The rectangle shown on the left side of FIG. 15 represents a head with five nozzles. The open circles shown on the right side represent small dots. In the example of FIG. 15, ink is ejected in oblique directions from some of the nozzles on the head, so that the positions of the dots created by such nozzles are deviated from the expected positions. In the illustrated example, the positions of the dots created by the first nozzle and the second nozzle are deviated from the expected positions.

In the case where small dots are recorded at a low recording ratio as shown in FIG. 15, there are relatively many gaps between rows of dots. In other words, there are relatively many pixels in which no dots are created. This makes the banding, which is caused by the deviation of the dot recording positions, relatively inconspicuous. In the example of FIG. 15, the presence of a gap B2, which is ascribed to the low recording density of dots, makes a banding B1 inconspicuous.

Figure 16:
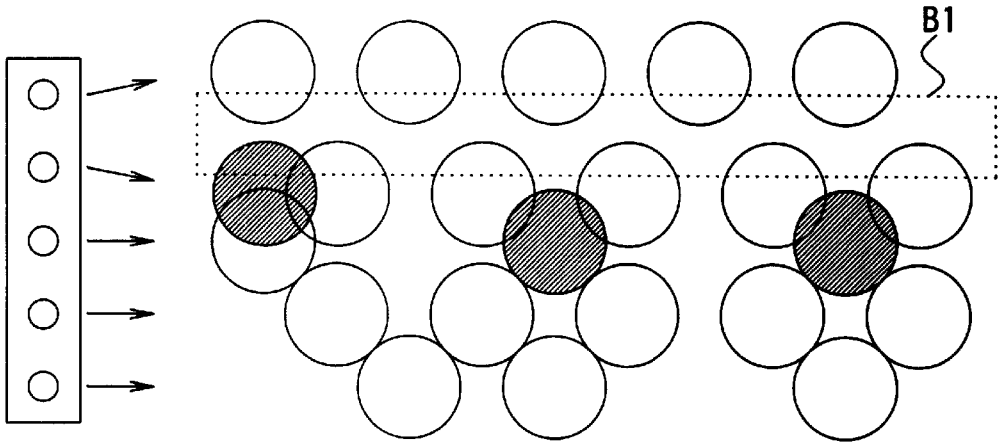
FIG. 16 shows a state of recording small dots at a second dot recording ratio.

FIG. 16 shows a state of dot creation at a little greater recording ratio. The hatched circles in FIG. 16 represent dots newly created in addition to the dots of FIG. 15. An increase in recording density of dots lessens the number of gaps between rows of dots and makes the banding rather conspicuous. In the example of FIG. 16, the presence of the hatched dots eliminates the gap B2, which is observed in the example of FIG. 15. This makes the banding B1 appear as the gap between rows of dots and easily recognizable with naked eyes as shown in FIG. 16. FIG. 16 shows only one example, and dots created at the identical recording ratio may have a pattern that makes the banding B1 relatively inconspicuous. The increase in recording ratio of the small dot generally makes the banding conspicuous, because of the reason discussed above. By taking into account the granularity of a printed image, on the other hand, it is preferable to increase the proportion of the small dot, which is not readily recognizable with naked eyes. There is, however, an upper limit in increased recording ratio of the small dot, in order to prevent the occurrence of banding and ensure the high picture quality.

In an area of relatively low tones, only small dots are created. When the tone value increases to naturally increase the recording ratio of the small dot, the banding is made to be conspicuous at or above a certain tone value. In this embodiment, the certain tone value is set as a limit tone value, up to which only small dots are used for recording. In the concrete example discussed above, the limit tone value is present between the tone value expressed by the recording ratio of FIG. 15 and the tone value expressed by the recording ratio of FIG. 16. The limit tone value is equal to a tone value g1 in the dot percent table DT shown in FIG. 12. DS1 denotes a limit recording ratio of the small dot specified against the limit tone value g1.

Figure 17:
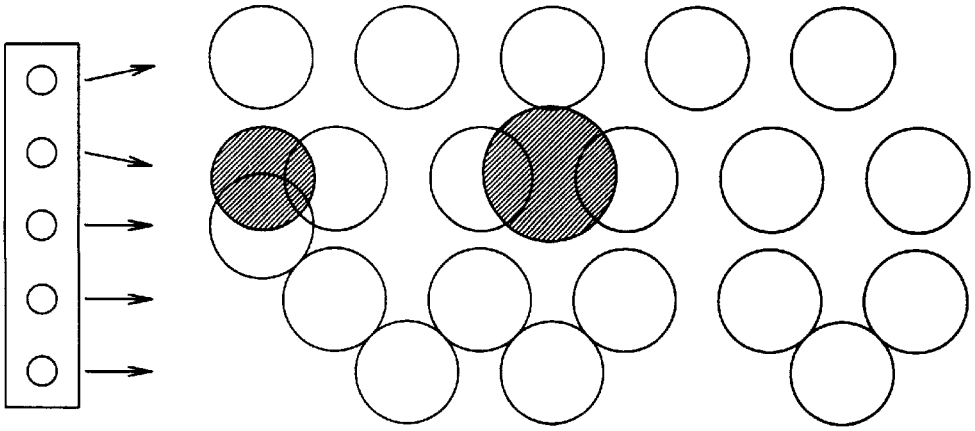
FIG. 17 shows a state of recording small dots mixed with large dots.

At the tone values of not less than g1, it is required to mix large dots with small dots, in order to prevent the occurrence of the conspicuous banding. The limit recording ratio DS1 is adopted in the case where only small dots are used for recording. When large dots are mixed with small dots, the recording ratio of the small dot can be heightened without causing the conspicuous banding. FIG. 17 shows a state of dot creation in the case where large dots are mixed with small dots. The hatched circles in FIG. 17 represent dots newly created in addition to the dots of FIG. 15. The large-diametral dot represents a large dot. In this example, the density expressed by one large dot coincides with the density expressed by two small dots. The dots of FIG. 17 as the whole area accordingly express the same density as that of FIG. 16.

The method of mixing large dots with small dots as shown in FIG. 17 keeps the banding inconspicuous even if the recording ratio of the small dot increases. This is ascribed to the greater size of the large dot. Even if there is a deviation of the dot recording positions as shown in FIG. 17, the greater size of the large dot eliminates the gap between adjoining rows of dots. In the case of a low recording ratio of the large dot, the banding is made to be conspicuous because of the reason discussed above with the drawings of FIGS. 15 and 16. In the area of the tone values of not less than g1 where large dots are mixed with small dots, the recording ratios of the small dot and the large dot are set to satisfy the three conditions, that is, to express each tone value, to avoid the occurrence of banding, and to improve the granularity of the printed image.

The following describes one concrete procedure of setting the recording ratios. In this example, it is assumed that the recording ratios are set against a certain tone value g2. The recording ratio of the large dot is set equal to a value DL1 as a first setting. Setting the recording ratio of the large dot automatically determines the recording ratio of the small dot required to express the tone value g2. The procedure creates dots at the preset recording ratios of the large dot and the small dot and determines whether or not a conspicuous banding occurs. From the viewpoint of the improved granularity, it is preferable that the small dot has a greater recording ratio. In the case where no banding occurs at the first setting, a value that is a little lower than the first value DL1 is set to the recording ratio of the large dot as a second setting. When a banding occurs at the first setting, on the other hand, it is required to lower the recording ratio of the small dot. A value that is a little greater than the first value DL1 is accordingly set to the recording ratio of the large dot as the second setting. In this manner, the recording ratio that satisfies the three conditions mentioned above, that is, the conditions regarding the tone expression, the inconspicuous banding, and the improvement in granularity, is refined consecutively. The procedure of this embodiment carried out such setting at some tone values and smoothly joined them to obtain the curves of the recording ratios shown in FIG. 12.

Figure 18:
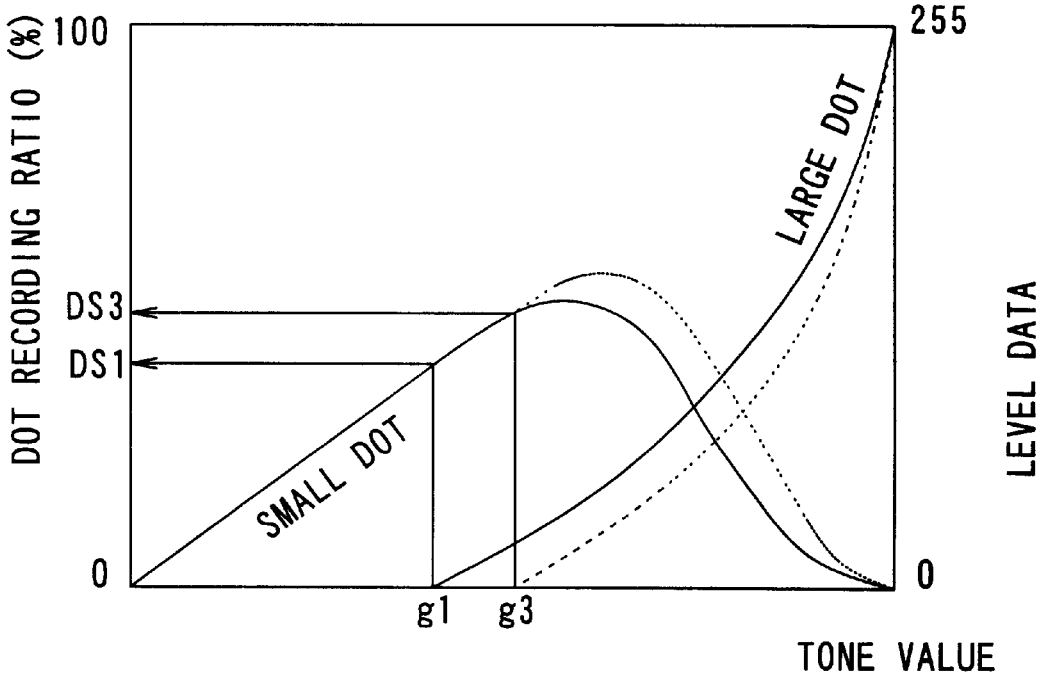
FIG. 18 is a graph showing a dot percent table set according to the printing condition.

As described previously, this embodiment provides the different dot percent tables DT for the respective combinations of printing conditions. By way of example, FIG. 18 shows recording ratios with regard to two different types of printing paper among the four options of the printing paper in this embodiment. The recording ratios shown by the solid curves regard the printing paper on which the dots created by a fixed quantity of ink have smaller diameters, that is, the special paper having a greater quantity of ink absorption per unit area. The recording ratios shown by the dotted curves regard the printing paper on which the dots created by the fixed quantity of ink have greater diameters, that is, the standard paper having a less quantity of ink absorption per unit area. When the area of the dot created by a fixed quantity of ink is referred to as a rate of dot coverage, the former corresponds to the printing paper having a low rate of dot coverage and the latter corresponds to the printing paper having a high rate of dot coverage. The recording ratios regarding the special paper have been discussed previously with the graph of FIG. 12A. As clearly shown in the graph of FIG. 18, the standard paper has the greater recording ratio of the small dot than the special paper. The limit tone value with regard to the standard paper, at which recording of the large dot starts, is equal to a value g3, which is greater than the limit tone value g1 with regard to the special paper. This is ascribed to the following reason.

Figure 19:
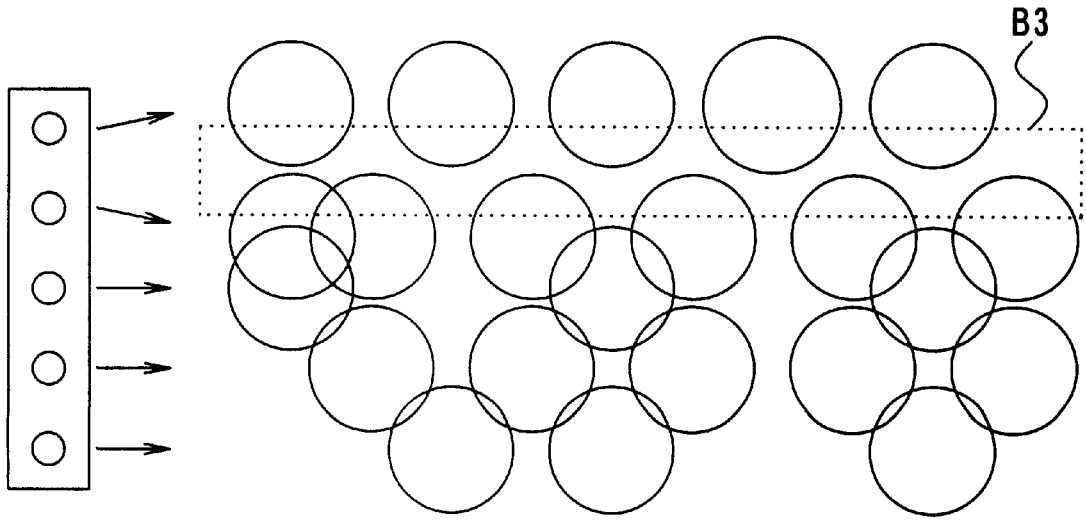
FIG. 19 shows a state of recording small dots at the second dot recording ratio on a printing medium where the dots created by a fixed quantity of ink have greater sizes.

FIG. 19 shows a state of dot creation on the standard paper. The symbols in FIG. 19 have the same meanings as those explained in FIGS. 15 through 17. In the example of FIG. 19, small dots are created in the same pattern as that of FIG. 16. Since the standard paper has the higher rate of dot coverage than the special paper, the respective dots created on the standard paper have greater diameters than the dots on the special paper. This causes a relatively narrow gap B3 in the example of FIG. 19, while there is a relatively large gap B1 due to the deviation of the dot recording positions in the example of FIG. 16. The frequency of the occurrence of banding is lower on the standard paper than on the special paper, when small dots are recorded at a fixed recording ratio. This widens the range of the tone values in which only small dots are created on the standard paper. According to this reason, in the case of the standard paper, the process of this embodiment sets the limit recording ratio against a tone value g3, at which recording of the large dot starts and up to which only the small dot is created, equal to a value DS3, which is greater than the limit recording ratio DS1 with regard to the special paper. Because of the same reason, after the start of recording of the large dot, the standard paper has the higher recording ratio of the small dot and the lower recording ratio of the large dot than the special paper.

As described previously, there are four options of the printing paper according to the quantity of ink absorption in this embodiment. The respective dot percent tables DT corresponding to the four options of the printing paper are set to heighten the recording ratio of the small dot with an increase in quantity of ink absorption because of the reason discussed above.

Figure 20:
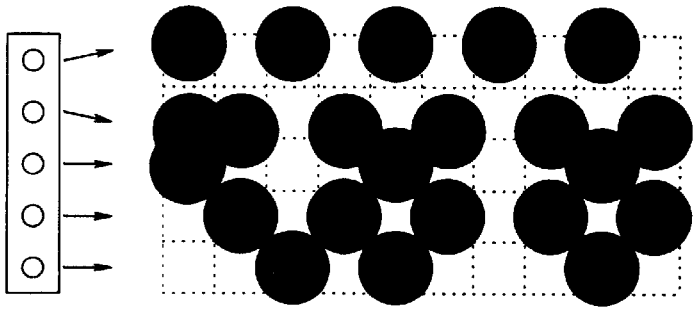
FIG. 20 shows a state of recording small dots at a first resolution.
Figure 21:
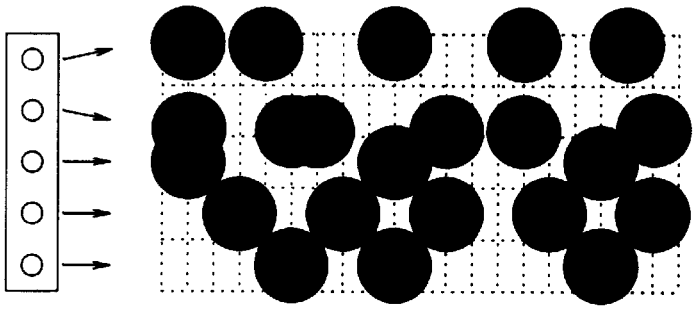
FIG. 21 shows a state of recording small dots at a second resolution.

As described previously, there are two options of the printing resolution in this embodiment. The following briefly describes the process of setting the dot recording ratio according to the printing resolution. FIGS. 20 and 21 show states of dot creation at different printing resolutions. The lattices of the broken line represent pixels in both FIGS. 20 and 21. FIG. 20 shows the case of a low resolution, and FIG. 21 shows the case of a high resolution. The example of FIG. 21 has the pixels in the lateral direction double the number of the pixels in the example of FIG. 20.

In the case of the low resolution (FIG. 20), the dot recording positions are limited, so that the positional relationship between the adjoining dots is relatively restricted. This increases the occurrence of the portions in which dots are aligned in a regular manner and the portions where dots face to each other in the vertical direction. These portions make the banding conspicuous. In the case of the high resolution (FIG. 21), on the other hand, there is a high degree of freedom in dot recording positions. This decreases the occurrence of the portions in which dots are aligned in a regular manner and the like and makes the banding inconspicuous. In the case of the high resolution, the range of tone values in which only small dots are created can thus be widened.

Because of the reasons discussed above, the process of this embodiment sets a greater value to the limit tone value, at which recording of the large dot starts, with an increase in resolution. The dot recording ratios may be set according to the resolution as shown in the graph of FIG. 18. In this case, the curves of the solid line regard the case of the low resolution and the curves of the dotted line regard the case of the high resolution.

As described previously, there are three options of the number of passes required to form each raster line in the course of printing in this embodiment. The three options in this embodiment include the case without the overlap recording (the number of passes=1), the case of overlap recording by the number of passes=2, and the case of overlap recording by the number of passes=4.

The increase in number of passes means the increase in number of nozzles used for formation of each raster line. In the case where one raster line is formed with a plurality of different nozzles, there is a difference in deviation of the recording positions of the dots on each raster line between the respective nozzles. This makes the banding, which is caused by the deviation of the dot recording positions, inconspicuous.

In one example, a certain raster line is formed by one pass only with one nozzle A. If ink is ejected in an oblique direction from the nozzle A, the recording positions of all the dots on the raster line are deviated from the expected positions. In another example, a certain raster line is formed by two passes with two nozzles A and B. It is assumed that ink is ejected in an oblique direction from the nozzle A but in a normal direction from the nozzle B. The recording positions of half the dots on the raster line are deviated from the expected positions, while the residual dots on the raster line are created at the expected positions. The banding is accordingly less conspicuous in the case of the raster line formation by two passes than in the case of the raster line formation by one pass. In general, the banding becomes less conspicuous with an increase in number of divisions of each raster line. With an increase in number of divisions of each raster line, the range of tone values in which only small dots are created is accordingly widened.

Because of the reason discussed above, the process of this embodiment sets a greater value to the limit tone value, at which recording of the large dot starts, with an increase in number of passes. The dot recording ratios may be set according to the number of passes as shown in the graph of FIG. 18. In this case, the curves of the solid line regard the recording ratios in the case of the less number of passes and the curves of the dotted line regard the recording ratios in the case of the greater number of passes.

As described previously with FIG. 6, this embodiment provides the higher-density ink and the lower-density ink with regard to cyan and magenta. The curves of dot recording ratios as shown in FIG. 12 are set for the respective inks. The dot recording ratios with regard to cyan, light cyan, magenta, and light magenta are thus set according to the respective combinations of the printing conditions. The following describes the dot recording ratios with regard to the higher-density ink and the lower-density ink having the same hue.

Figure 22:
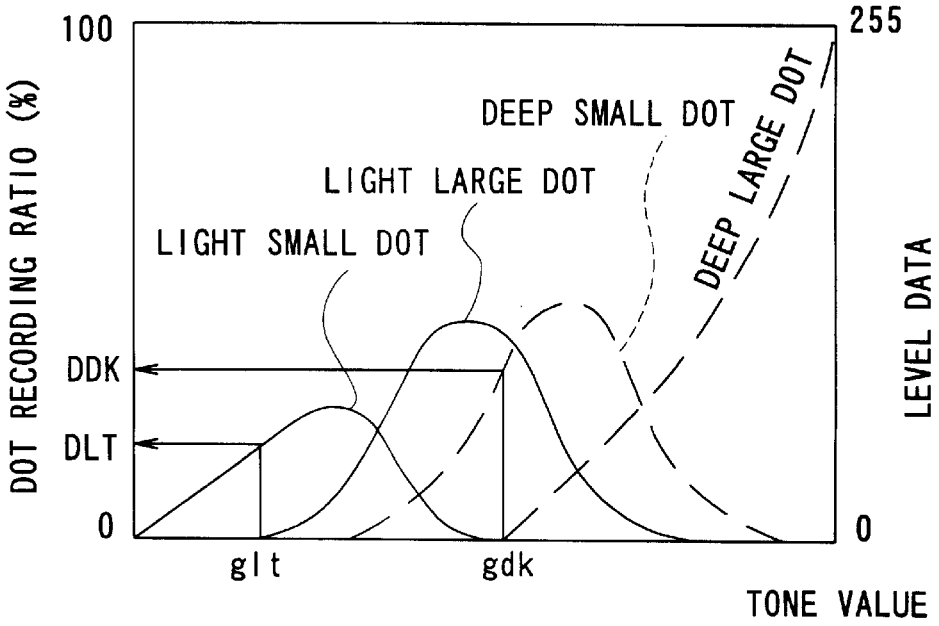
FIG. 22 is a graph showing the dot recording ratios with regard to the light ink and the deep ink.
Figure 23:
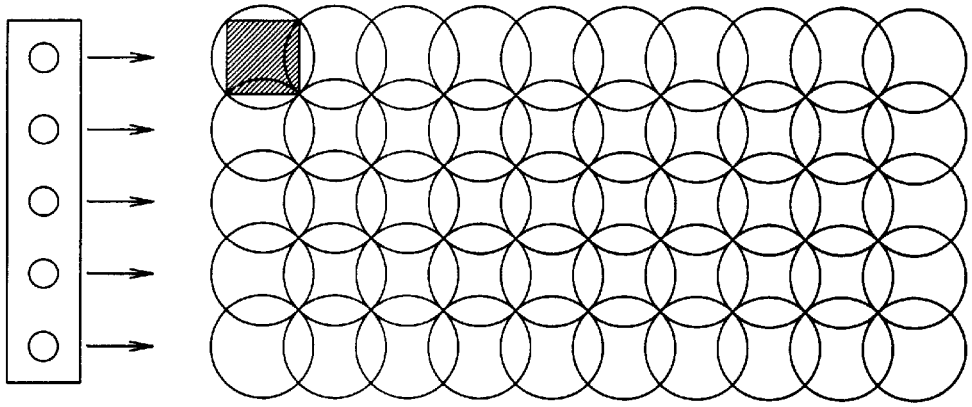
FIG. 23 shows a state of recording small dots without any deviation of the dot recording positions.
Figure 24:
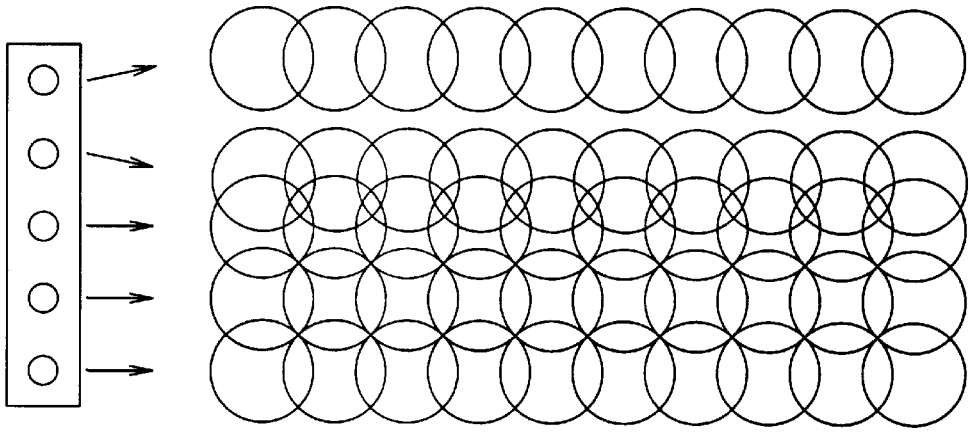
FIG. 24 shows a state of recording small dots with some deviation of the dot recording positions.
Figure 25:
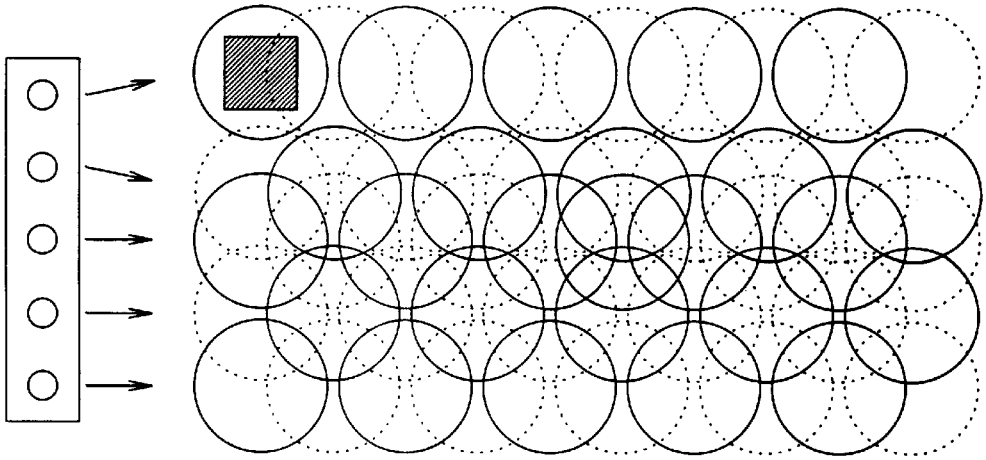
FIG. 25 shows a state of recording large dots with some deviation of the dot recording positions.

FIG. 22 is a graph showing the dot recording ratios of the lower-density ink (light ink) and the higher-density ink (deep ink). The graph of FIG. 22 is set corresponding to a certain printing condition. The higher-density ink is generally used for relatively high tone values, that is, for relatively dark portions in the printed image. As clearly seen from the graph of FIG. 22, the recording ratios of the deep small dot and the deep large dot are equal to zero in the area of low tone values.

In a certain range of tone values where the deep ink is used for creation of dots, before dots are created with the higher-density ink, a large number of dots have already been created with the lower-density ink. As shown in FIG. 22, at a specific tone value where recording of the deep small dot starts, light small dots and light large dots have already been recorded at certain recording ratios. Even if there is a deviation of the recording positions of dots created with the deep ink, the large number of dots created with the light ink make the banding inconspicuous. This is because there is a possibility of creating light large dots to compensate for the deviation of the recording positions of the deep small dots. In the area of low tone values where only light small dots are created, on the other hand, the deep ink is not used for creation of dots. The above effect is accordingly not expected and there may be a conspicuous banding in the area of low tone values.

Based on the reason discussed above, as shown in FIG. 22, the process of this embodiment sets a recording ratio DDK of the deep small dot against a limit tone value gdk, at which recording of the deep large dot starts, to be greater than a recording ratio DLT of the light small dot against a limit tone value glt, at which recording of the light large dot starts. The possibility of the occurrence of banding depends upon not only the density of ink but the hue. As described with FIG. 6, this embodiment provides six color inks. When dots are created at a fixed recording ratio, the banding is more conspicuous in some of the colors and less conspicuous in other colors. This embodiment sets the dot recording ratios (see FIG. 12) for the respective color inks by taking into account this point.

The printing system of this embodiment sets the dot recording ratios corresponding to the variety of printing conditions by taking into account the possibility of the occurrence of banding. This arrangement prevents the conspicuous banding from appearing under any printing condition. The method of setting the recording ratio of a specific type of dot according to the printing condition enables recording of the small dot at a maximum recording ratio that is allowable in the range where banding does not occur with regard to the printing condition. The printing system of this embodiment thus prevents the occurrence of banding and ensures the high picture quality of the resulting printed image, while keeping the favorable granularity of the printed image, with respect to each printing condition.

In this embodiment, the dither method is adopted in the multi-valuing process. A variety of other methods, for example, the error diffusion method, are, however, applicable to the multi-valuing process. The above embodiment specifies the twenty-four printing conditions as the combinations of the three elements, the printing medium, the resolution, and the number of passes. The printing conditions may otherwise be specified as combinations of a greater number of elements. Alternatively the number of options regarding each element may be increased; for example, the options of the printing medium may be increased.

In the above embodiment, the dot recording ratio is set according to the printing condition. In one modified arrangement, the recording ratio may be set to a fixed value, regardless of the difference in some elements of the printing condition. By way of example, the dot recording ratio may be set only corresponding to specific elements that remarkably improve the picture quality with a variation in dot recording ratio, among a variety of elements that specify the printing condition. This modified arrangement saves the storage capacity for storing the dot percent tables. This arrangement also shortens the time period required for referring to the dot percent table in the multi-valuing process and thereby improves the processing speed as a whole.

The above embodiment regards the printer that enables three-valued expression for each pixel by creating two different types of dots, that is, the large dot and the small dot. The principle of the present invention may, however, be applied to the other multi-value printers that enable expression of a greater number of tone values. The principle of the invention is also applicable to the printers that enable creation of a greater number of different types of dots having different sizes and to the printers that enable creation of dots with a greater number of different inks having different densities. The embodiment relates to the ink jet printer with piezoelectric elements. The principle of the present invention is also applicable to a variety of printers and other printing apparatuses, for example, a printer that supplies electricity to a heater attached to the nozzles and utilizes the bubbles generated in the ink to eject ink.

Figure 11:
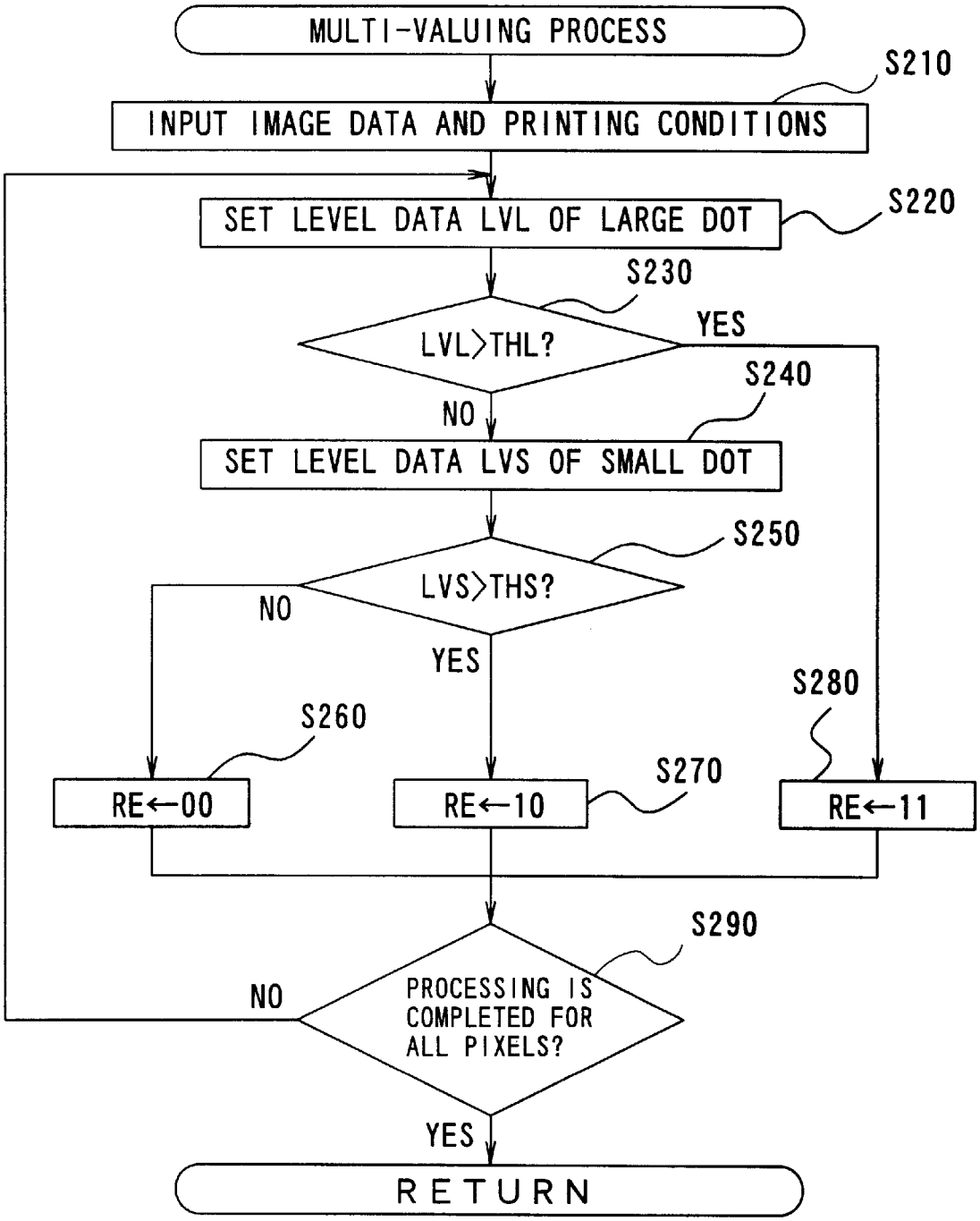
FIG. 11 is a flowchart showing details of the multi-valuing process carried out at step S200 in the flowchart of FIG. 10.

The printing system described above includes the processes implemented by the computer, such as the processes shown in the flowcharts of FIGS. 10 and 11. One possible application of the present invention is accordingly a recording medium, in which a program for attaining the processing is recorded. Typical examples of the recording media include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media. Still another application of the invention is a program supply apparatus that supplies a computer program, which causes the computer to carry out the image processing and other processes discussed above, to the computer via a communication path.

The present invention is not restricted to the above embodiment or its modifications, but there may be many other modifications, changes, and alterations without departing from the scope or spirit of the main characteristics of the present invention. For example, a variety of control operations discussed above in the embodiment may be partly or totally attained by a hardware configuration.

The scope and spirit of the present invention are limited only by the terms of the appended claims.

What is claimed is:

1. A printer with a head having a plurality of nozzles that enable creation of at least two different types of dots having different sizes, said printer determining which of the at least two different types of dots is to be created in a pixel according to a printing condition and a tone value of image data and creating dots based on a result of the determination with said head, thereby printing an image on a printing medium, said printer comprising:

a memory unit that stores relations between the recording ratio of each type of dot and the tone value with regard to printing conditions;

a printing condition input unit that inputs a specified printing condition; and a decision unit that determines whether one of at least two different types of dots is to be created in a pixel, based on the recording ratio corresponding to the specified printing condition stored in said memory unit, wherein different values are set to a limit recording ratio of a specific type of dot, which is selected among the at least two different types of dots and enables independent expression of a certain tone value, corresponding to the printing condition and the limit recording ratio is specified against a limit time value, at which a recording ratio of another type of dot having a greater size than the specific type of dot affects banding due to recording the specific type of dot.

2. A printer in accordance with claim 1, wherein the specific type of dot has a size that is substantially identical with a dot pitch in printing.

3. A printer in accordance with claim 1, wherein the limit recording ratio is set based on a possibility of occurrence of banding.

4. A printer in accordance with claim 1, wherein the specified printing condition is the size of a dot created with a certain quantity of ink on said printing medium, and the recording ratio of the specific type of dot increases with an increase in size of the dot.

5. A printer in accordance with claim 1, said printer further comprising:

a unit that causes each raster line, which is an array of dots aligned in one direction on said printing medium, to be formed by a plurality of divisional scans with said head, and carries out a sub-scan that moves said printing medium relative to said head in a direction that crosses the direction of the alignment of dot in the raster line, in order to enable each raster line to be formed with different nozzles, wherein the specified printing condition is a number of divisional scans required for forming each raster line, and the recording ratio of the specific type of dot increases with an increase in number of divisional scans.

6. A printer in accordance with claim 1, wherein the specified printing condition is a printing resolution, and the recording ratio of the specific type of dot increases with an increase in printing resolution.

7. A printer in accordance with claim 1, wherein said head enables creation of the at least two different types of dots having different sizes with inks of different densities having an identical hue, and the recording ratio of the specific type of dot is set for each ink having a different density.

8. A printer in accordance with claim 7, wherein the recording ratio of the specific type of dot increases with an increase in density of ink.

9. A printer in accordance with claim 1, wherein said head enables creation of the at least two different types of dots having different sizes with inks of different hues, and the recording ratio of the specific type of dot is set for each ink having a different hue.

10. A printer with a head in accordance with claims 1 or 9, wherein the printing condition includes at least one of a type of printing paper, an amount of printing resolution, and a number of main scans required for formation of a raster line.

11. A printer with a head having a plurality of nozzles that enable creation of at least two different types of dots having different sizes, said printer determining whether one of the at least two different types of dots is to be created in a pixel according to a printing condition and a tone value of image data and creating dots based on a result of the determination with said head, thereby printing an image on a printing medium, wherein the at least two different types of dots include a specific type of dot having a size that is substantially identical with a dot pitch in printing, and a limit recording ratio of the specific type of dot is specified against a limit tone value, at which a recording ratio of another type of dot having a greater size than the specific type of dot, and is set corresponding to the printing condition by taking into account a possibility of occurrence of banding.

12. A recording medium in which a program is recorded in a computer readable manner, said program causing a computer to generate data, which are supplied to a printer that creates at least two different types of dots having different sizes and prints an image, based on input image data, said program comprising:

at least specific data that specify relations between recording ratios of different types of dots and a tone value corresponding to a printing condition, the specific data comprising different values set to a limit recording ratio, up to which only a specific type of dot that is selected among the at least two different types of dots and enables independent expression of a certain tone value is recorded, corresponding to the printing condition, said program causing the computer to attain the functions of:

inputting a tone value of a pixel and a printing condition; and specifying different types of dots to be created in a pixel based on an input tone value and an input printing condition, in order to attain a recording ratio stored in the specific data.

13. A recording medium in accordance with claim 12, wherein the limit recording ratio included in the specific data increases with an increase in size of the specific type of dot created on said printing medium.

14. A recording medium in accordance with claim 12, wherein the limit recording ratio included in the specific data increases with an increase in number of divisional scans to complete each raster line.

15. A recording medium in accordance with claim 12, wherein the limit recording ratio included in the specific data increases with an increase in printing resolution.

16. A recording medium in accordance with claim 12, wherein said program causes the computer to generate data, which are supplied to said printer that creates the at least two different types of dots having different sizes with inks of different densities having an identical hue and prints an image, and the limit recording ratio included in the specific data increases with an increase in density of ink.

17. A recording medium in accordance with claim 12, wherein the printing condition includes at least one of a type of printing paper, an amount of printing resolution, and a number of main scans required for formation of a raster line.

18. A printing apparatus comprising:

a printing condition input unit that inputs a specified printing condition;

a memory unit that stores relations between a recording ratio of at least two different types of dots and a tone value with regard to a printing condition;

a printer with a head, wherein the head creates at least two different types of dots; and a device configured to determine whether one of at least two different types of dots is created in a pixel, based on a recording ratio corresponding to the specified printing condition stored in the memory unit, and configured to further determine different values for the recording ratio and the tone value for a specific type of dot when another type of dot, having a greater size than a specific type of dot and that prevents conspicuous banding, is created in a pixel, based on a limit recording ratio and a limit tone value.

* * * * *